US010010185B2

(12) United States Patent
Adams et al.

(10) Patent No.: US 10,010,185 B2
(45) Date of Patent: Jul. 3, 2018

(54) SOFA HAVING POWERED OTTOMAN

(71) Applicant: La-Z-Boy Incorporated, Monroe, MI (US)

(72) Inventors: Chad E. Adams, Perrysburg, OH (US); Larry P. LaPointe, Temperance, MI (US); Jason Rains, Evensville, TN (US); Jason Bryson, Athens, TN (US); Ericka Norling, Dayton, TN (US); Tahir Ahmad, Dundee, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 253 days.

(21) Appl. No.: 14/978,601

(22) Filed: Dec. 22, 2015

(65) Prior Publication Data

US 2017/0071352 A1 Mar. 16, 2017

Related U.S. Application Data

(60) Provisional application No. 62/219,445, filed on Sep. 16, 2015.

(51) Int. Cl.

| | |
|---|---|
| ***A47C 17/13*** | (2006.01) |
| ***A47C 17/16*** | (2006.01) |
| ***A47C 17/175*** | (2006.01) |

(52) U.S. Cl.

CPC ..... *A47C 17/138* (2013.01); *A47C 17/16* (2013.01); *A47C 17/163* (2013.01); *A47C 17/175* (2013.01); *A47C 17/13* (2013.01)

(58) Field of Classification Search

CPC ..... A47C 17/138; A47C 17/13; A47C 17/04; A47C 17/132; A47C 17/134;

(Continued)

(56) References Cited

U.S. PATENT DOCUMENTS 4,570,996 A * 2/1986 Rogers, Jr. ..... A47C 7/506 297/68

4,861,101 A 8/1989 Hartline (Continued)

FOREIGN PATENT DOCUMENTS

EP 0496249 A1 7/1992

OTHER PUBLICATIONS

International Search Report and Written Opinion of the International Searching Authority for PCT/US2016/068322, dated Apr. 17, 2017.

*Primary Examiner* — Eric J Kurilla
*Assistant Examiner* — Amanda L Bailey
(74) *Attorney, Agent, or Firm* — Harness, Dickey & Pierce, P.L.C.

(57) ABSTRACT

A furniture member may include a base frame, a seat bottom and an ottoman assembly. The seat bottom is attached to the base frame and defines a seating surface. The ottoman assembly may include a drive assembly that moves an ottoman platform relative to the seat bottom and the base frame among a retracted position, an extended position and a raised position. The ottoman platform includes a support surface that faces upward and away from a ground surface in the retracted, extended and raised positions. The ottoman platform is disposed beneath the seating surface in the retracted position and moves linearly in a horizontal direction from the retracted position to the extended position. The ottoman platform moves linearly in a vertically upward direction from the extended position to the raised position.

22 Claims, 29 Drawing Sheets

(58) Field of Classification Search
CPC ..... A47C 17/136; A47C 17/16; A47C 17/161; A47C 17/162; A47C 17/163; A47C 17/17; A47C 17/175; A47C 17/1753; A47C 20/041; A47C 1/03211; A47C 1/0242
See application file for complete search history.

(56) References Cited

U.S. PATENT DOCUMENTS

| | | | | |
|---|---|---|---|---|
| 5,123,705 | A | 6/1992 | Johnson | |
| 5,794,283 | A * | 8/1998 | Vila | A47C 17/2073 5/18.1 |
| 6,588,837 | B1 | 7/2003 | Schultz et al. | |
| 2005/0052067 | A1 * | 3/2005 | Grimm | A47C 1/03211 297/423.2 |
| 2014/0265497 | A1 * | 9/2014 | Hough | A61G 5/14 297/316 |
| 2015/0040314 | A1 | 2/2015 | Rodriguez | |

* cited by examiner

SOFA HAVING POWERED OTTOMAN

CROSS-REFERENCE TO RELATED APPLICATIONS

This application claims the benefit of U.S. Provisional Application No. 62/219,445, filed on Sep. 16, 2015. The entire disclosure of the above application is incorporated herein by reference.

FIELD

The present disclosure relates to a powered ottoman for a furniture member.

BACKGROUND

This section provides background information related to the present disclosure and is not necessarily prior art.

Furniture members (e.g., chairs, sofas, loveseats, etc.) can include a leg rest that can be rotated between stowed and deployed positions. Such functionality is often a tradeoff with aesthetic design. That is, the aesthetic design options of such conventional motion furniture members are often limited to accommodate mechanisms that enable deploying and stowing the leg rest. Conventional recliner and leg rest mechanisms prohibit certain aesthetic design features and styles that are popular in modern stationary furniture members. The present disclosure provides furniture members that incorporate stowable ottoman assemblies that allow for desirable aesthetic design features that are not feasible with conventional leg rest mechanisms.

SUMMARY

This section provides a general summary of the disclosure, and is not a comprehensive disclosure of its full scope or all of its features.

In one form, the present disclosure provides a furniture member that may include a base frame, a seat bottom and an ottoman assembly. The seat bottom is attached to the base frame and defines a seating surface. The ottoman assembly may include a drive assembly that moves an ottoman platform relative to the seat bottom and the base frame among a retracted position, an extended position and a raised position. The ottoman platform includes a support surface that faces upward and away from a ground surface in the retracted, extended and raised positions. The ottoman platform is disposed beneath the seating surface in the retracted position and moves linearly in a horizontal direction from the retracted position to the extended position. The ottoman platform moves linearly in a vertically upward direction from the extended position to the raised position.

In some configurations, the seat bottom is stationary relative to the base frame as the ottoman platform moves among the retracted, extended and raised positions.

In some configurations, the drive assembly includes a first motor-driven actuator driving the ottoman platform between the retracted and extended positions and a second motor-driven actuator driving the ottoman platform between the extended and raised positions.

In some configurations, the furniture member includes a third motor-driven actuator drivingly connected to the seat bottom and driving the seat bottom horizontally relative to the base frame; and a seatback pivotably attached to the seat bottom and the base frame such that movement of the seat bottom relative to the base frame causes corresponding rotation of the seatback relative to the seat bottom and the base frame.

In some configurations, the ottoman platform is movable horizontally relative to the base frame from the raised position to an ottoman sleeper position in response to movement of the seat bottom horizontally relative to the base frame.

In some configurations, the seatback includes a first side that faces a seatback cushion when the seatback is in an upright position. The seatback may be rotated into a seatback sleeper position as the ottoman platform moves into the ottoman sleeper position. The first side of the seatback may face vertically upward in the seatback sleeper position such that the seatback cushion cooperates with an ottoman cushion and a seat bottom cushion to define a horizontal sleep surface.

In some configurations, the ottoman assembly includes an ottoman frame supporting the ottoman platform, an extension mechanism attached to the ottoman frame and the base frame and moving the ottoman platform between the retracted and extended positions, and a lift mechanism attached to the ottoman frame and the ottoman platform and moving the ottoman platform between the extended and raised positions.

In some configurations, the ottoman frame includes a plurality of rollers mounted thereto that roll along the ground surface as the ottoman assembly moves between the extended and retracted positions.

In some configurations, the lift mechanism includes a first scissor linkage.

In some configurations, the extension mechanism includes a second scissor linkage that operates independently of the first scissor linkage.

In some configurations, the seat bottom includes a pair of first track members, and the ottoman frame includes a pair of second track members that slidingly engage the first track members.

In some configurations, the first track members slide along the second track members in a linear path.

In some configurations, the base frame includes a pair of third track members. The seat bottom may slidably engage the third track members. The third track members may extend in a linear direction.

In some configurations, an upward-facing surface of a seat bottom cushion is substantially level with an upward-facing surface of an ottoman cushion of the ottoman platform when the ottoman platform is in the raised position.

In some configurations, the furniture member includes a seatback that is fixed relative to the seat bottom and the base frame.

In some configurations, the furniture member includes a shroud panel attached to the ottoman platform and movable with the ottoman platform between a folded condition and an unfurled condition as the ottoman platform moves vertically between the extended position and the raised position. The shroud panel shields the drive assembly from a user's view when the ottoman platform is in the raised position.

In some configurations, the furniture member includes an elongated elastic strip fixed at one end to the shroud panel and fixed at the other end to the upward-facing support surface of the ottoman platform. Movement of the ottoman platform toward the raised position resiliently stretches the elastic strip such that movement of the ottoman platform downward away from the raised position allows the elastic strip to pull a portion of the shroud panel underneath the ottoman platform.

In some configurations, the shroud panel is pulled taut in the unfurled condition.

In some configurations, the ottoman platform includes a slot through which the elastic strip extends.

In some configurations, an upper edge of the shroud panel is fixed to a side of the ottoman platform, and a lower edge of the shroud panel is fixed to an ottoman frame member supporting the drive assembly.

In some configurations, the elastic strip is attached to the a seam of the shroud panel that is spaced apart from the upper and lower edges.

In another form, the present disclosure provides a furniture member that may include a stationary base frame, a seat bottom, a seatback, a first link and a second link. The seat bottom may be attached to the base frame and may be movable relative to the base frame between a first position and a second position. The seatback may be attached to the seat bottom and the base frame and may be rotatable relative to the seat bottom and the base frame. The first link may be rotatably coupled to the seatback and rotatably coupled to the seat bottom. The second link may be rotatably coupled to the seatback and rotatably coupled to the base frame.

In some configurations, the seat bottom includes a seat bottom cushion, and the seatback includes a first side that faces a seatback cushion when the seatback is in an upright position. The seatback may be rotated into a sleeper position as the seat bottom moves from the first position to the second position. The first side of the seatback may face vertically upward in the sleeper position such that the seatback cushion cooperates with the seat bottom cushion to define a horizontal sleep surface.

In some configurations, an upward-facing surface of the seat bottom cushion is substantially level with an upward-facing surface of the ottoman cushion when the ottoman platform is in the raised position.

In some configurations, the seat bottom moves in a linear horizontal direction between the first and second positions.

In some configurations, the furniture member includes an ottoman assembly including a drive assembly that moves an ottoman platform relative to the seat bottom and the base frame between a retracted position in which the ottoman platform is disposed underneath the seat bottom and a sleeper position in which the ottoman platform is disposed adjacent the seat bottom such that an ottoman cushion supported by the ottoman platform cooperates with the seat bottom cushion and the seatback cushion to form the horizontal sleep surface.

In some configurations, the drive assembly moves the ottoman platform relative to the seat bottom and the base frame among the retracted position, an extended position, a raised position and the sleeper position. The ottoman platform may include a support surface that faces upward and away from a ground surface in the retracted, extended, raised and sleeper positions. The ottoman platform may be disposed beneath the seating surface in the retracted position and may move linearly in a horizontal direction from the retracted position to the extended position. The ottoman platform may move linearly in a vertically upward direction from the extended position to the raised position.

In some configurations, the ottoman assembly includes an ottoman frame supporting the ottoman platform, an extension mechanism attached to the ottoman frame and the base frame and moving the ottoman platform between the retracted and extended positions, and a lift mechanism attached to the ottoman frame and the ottoman platform and moving the ottoman platform between the extended and raised positions.

In some configurations, the ottoman frame includes a plurality of rollers mounted thereto that roll along the ground surface as the ottoman assembly moves between the extended and retracted positions.

In some configurations, the lift mechanism includes a first scissor linkage.

In some configurations, the extension mechanism includes a second scissor linkage that operates independently of the first scissor linkage.

In some configurations, the seat bottom includes a pair of first track members, and the ottoman frame includes a pair of second track members that slidingly engage the first track members.

In some configurations, the first track members slide along the second track members in a linear path.

In some configurations, the base frame includes a pair of third track members. The seat bottom may slidably engage the third track members. The third track members may extend in a linear direction.

In another form, the present disclosure provides a furniture member that may include a stationary base frame, a seat bottom, a seatback, and an ottoman assembly. The seat bottom may be attached to the base frame and may be movable relative to the base frame between a rearward position and a forward position. The seatback may be attached to the seat bottom and the base frame and may be rotatable relative to the seat bottom and the base frame between an upright position and a laid-down position. The seatback may rotate from the upright position to the laid-down position simultaneously with movement of the seat bottom from the rearward position to the forward position. The ottoman assembly may be attached to the seat bottom and may include a drive assembly that moves an ottoman platform relative to the seat bottom and the base frame between a retracted position in which the ottoman platform is disposed underneath the seat bottom and a sleeper position in which the ottoman platform is disposed adjacent the seat bottom such that an ottoman cushion supported by the ottoman platform cooperates with a seat bottom cushion and a seatback cushion to form a horizontal sleep surface.

In some configurations, the seat bottom moves in a linear horizontal direction between the first and second positions.

In some configurations, the drive assembly moves the ottoman platform relative to the seat bottom and the base frame among the retracted position, an extended position, a raised position and the sleeper position. The ottoman platform may include a support surface that faces upward and away from a ground surface in the retracted, extended, raised and sleeper positions. The ottoman platform may be disposed beneath the seating surface in the retracted position and may move linearly in a horizontal direction from the retracted position to the extended position. The ottoman platform may move linearly in a vertically upward direction from the extended position to the raised position. The ottoman platform may move linearly in a forward horizontal direction from the raised position to the sleeper position as the seat bottom moves from the rearward position to the forward position.

In some configurations, the furniture member includes a first motor-driven actuator that moves the ottoman assembly horizontally between the retracted and extended positions; a second motor-driven actuator that moves the ottoman assembly vertically between the extended and raised positions; and a third motor-driven actuator that moves the ottoman assembly horizontally between the raised and sleeper positions and moves the seatback between the upright position and the laid-down position. In some configurations, the first and second motor-driven actuators are sequenced together and the third motor-driven actuator is operable independently of the first and second motor-driven actuators.

In some configurations, the ottoman assembly includes an ottoman frame supporting the ottoman platform, an extension mechanism attached to the ottoman frame and the base frame and moving the ottoman platform between the retracted and extended positions, and a lift mechanism attached to the ottoman frame and the ottoman platform and moving the ottoman platform between the extended and raised positions.

In some configurations, the ottoman frame includes a plurality of rollers mounted thereto that roll along a ground surface as the ottoman assembly moves between the extended and retracted positions.

In some configurations, the lift mechanism includes a first scissor linkage.

In some configurations, the extension mechanism includes a second scissor linkage that operates independently of the first scissor linkage.

In some configurations, the seat bottom includes a pair of first track members, and the ottoman frame includes a pair of second track members that slidingly engage the first track members.

In some configurations, the first track members slide along the second track members in a linear path.

In some configurations, the base frame includes a pair of third track members. The seat bottom may slidably engage the third track members. The third track members may extend in a linear direction.

In some configurations, a person can remain seated on the seat bottom with the person's back contacting the seatback cushion throughout the entire range of motion of the seatback and the ottoman assembly.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
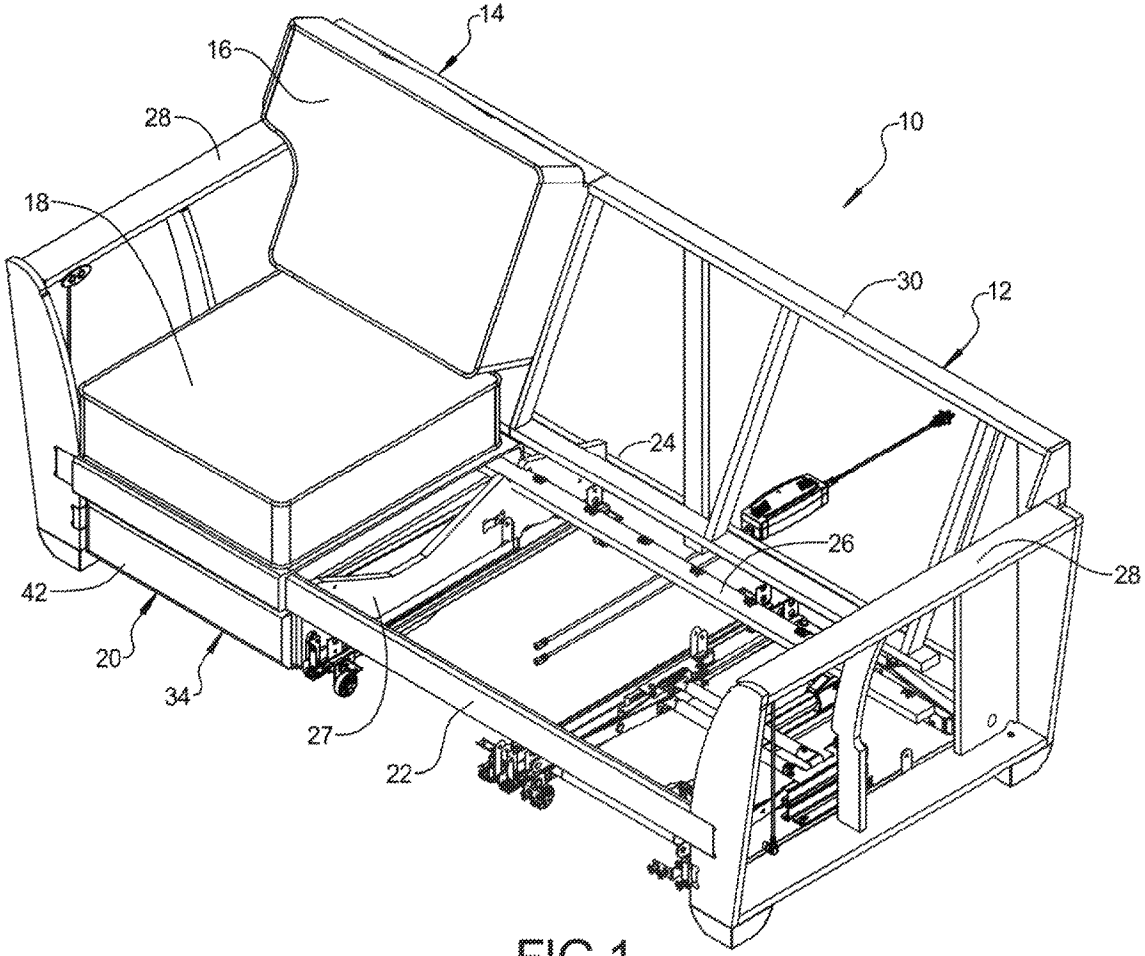
FIG. 1 is a perspective view of a portion of a furniture member having an ottoman assembly in a stowed position according to the principles of the present disclosure.
Figure 2:
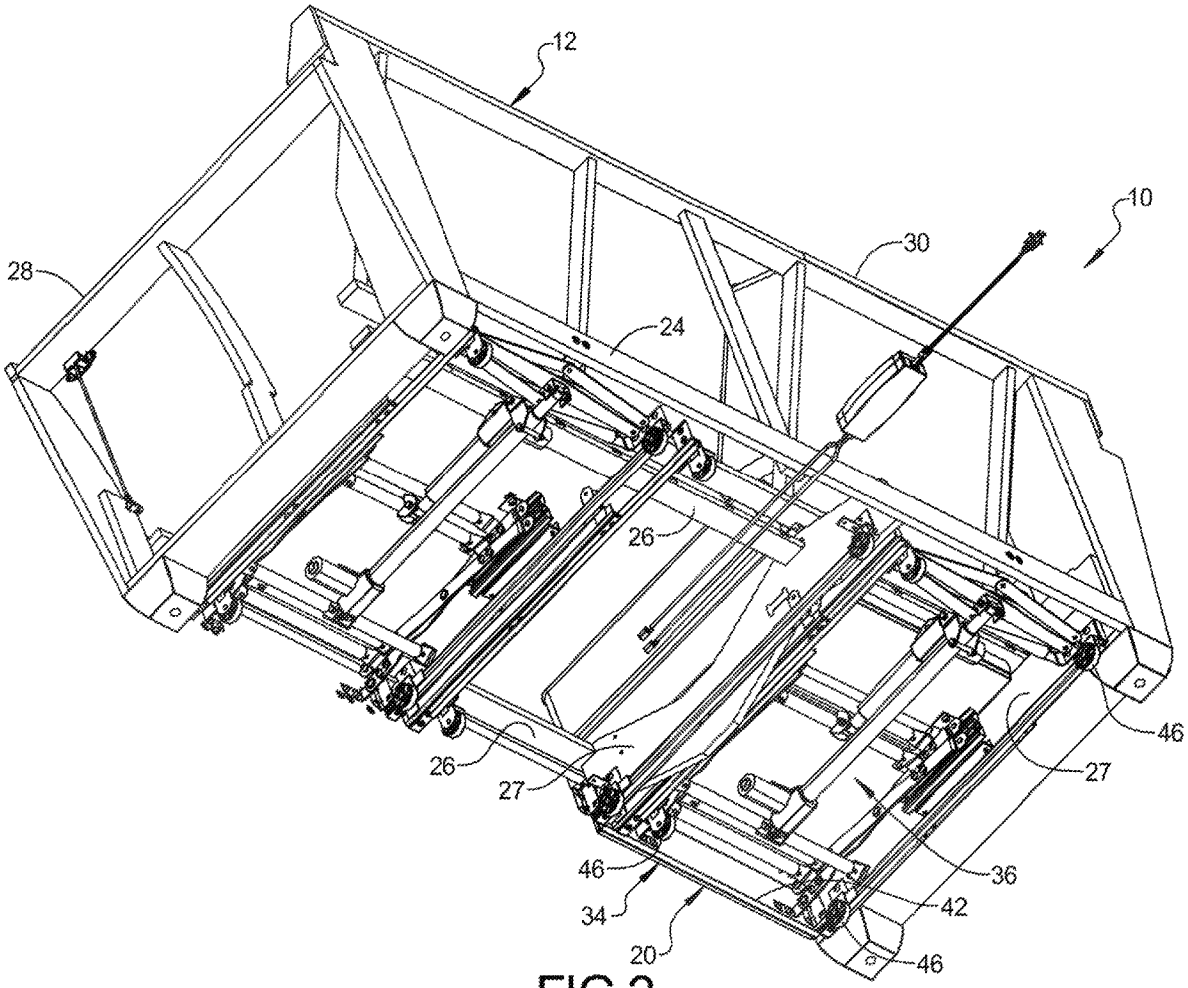
FIG. 2 is another perspective view of the portion of the furniture member of FIG. 1 with the ottoman assembly in the stowed position.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-11, a furniture member 10 is provided that may include a base frame 12 and one or more seat assemblies 14. Each seat assembly 14 includes a seatback 16, a seat bottom 18, and a movable ottoman assembly 20. As shown in FIGS. 1-5, the base frame 12 may be a stationary construction and may support the seatback 16, the seat bottom 18 and the ottoman assembly 20. The base frame 12 may include a front support member 22, a rear support member 24, a plurality of lateral cross members 26, a plurality of fore-aft cross members 27, a pair of armrests 28, and a seatback support frame 30. In some configurations, the seatback 16 and seat bottom 18 may be movable relative to each other and the base frame 12. In other configurations, the seatback 16 and/or the seat bottom 18 may be fixed relative to the base frame 12 and/or each other. As will be described in more detail below, the ottoman assembly 20 is movable relative to the base frame 12, the seatback 16 and the seat bottom 18 between a retracted or stowed position (FIGS. 1, 2 and 6) and an extended position (FIGS. 7 and 8), and between the extended position and a raised position (FIGS. 3-5 and 9-11).

The ottoman assembly 20 may include an ottoman platform 32, an ottoman frame 34, and a drive assembly 36. The ottoman platform 32 may include an upholstered cushion 38 and a shroud 40 (FIG. 3) that extends downward from three or four sides of the cushion 38 to block a user's view of the drive assembly 36 when the ottoman platform 32 is in the raised position.

As shown in FIGS. 4 and 6-11, the ottoman frame 34 may include a plurality of support members 42, a pair of linear first track members 44 fixed to corresponding support members 42, and a plurality of wheels or rollers 46 attached to the support members 42 and/or the first track members 44. The support members 42 may cooperate with the shroud 40 to block a user's view of the drive assembly 36 when the ottoman platform 32 is in the raised position. Each of the first track members 44 may slidably (or rollingly) engage a corresponding one of a pair of linear second track members 48 (FIGS. 3 and 4) that may be fixedly attached to the base frame 12 (e.g., at the fore-aft cross members 27). The wheels or rollers 46 may roll along the floor or ground surface (i.e., the floor surface upon which the furniture member 10 is situated) and may movably support the ottoman assembly 20 as the first track members 44 move along the second track members 48 to move the ottoman assembly 20 between the stowed and extended positions.

Figure 6:
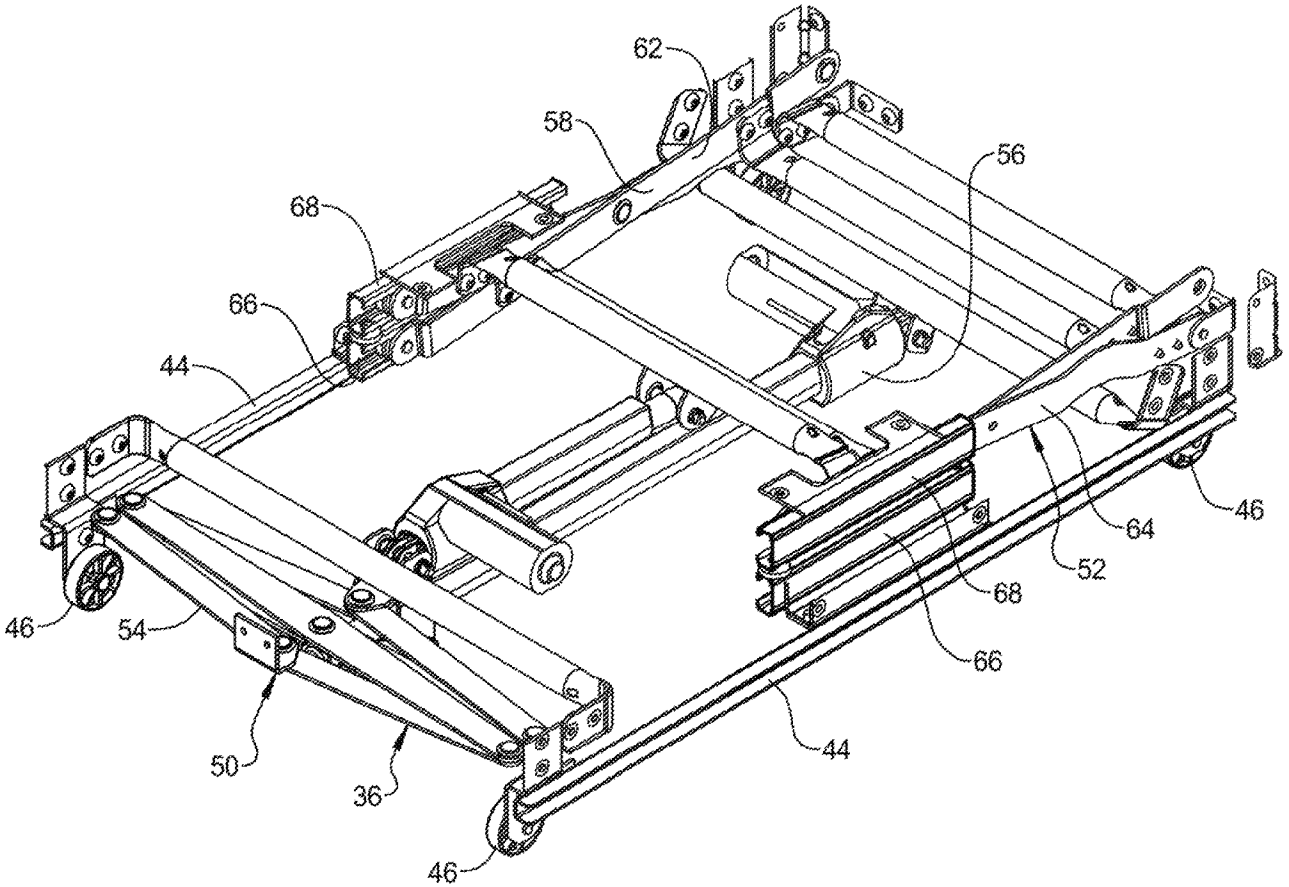
FIG. 6 is a perspective view of a portion of the ottoman assembly of FIG. 1 in the stowed position.
Figure 7:
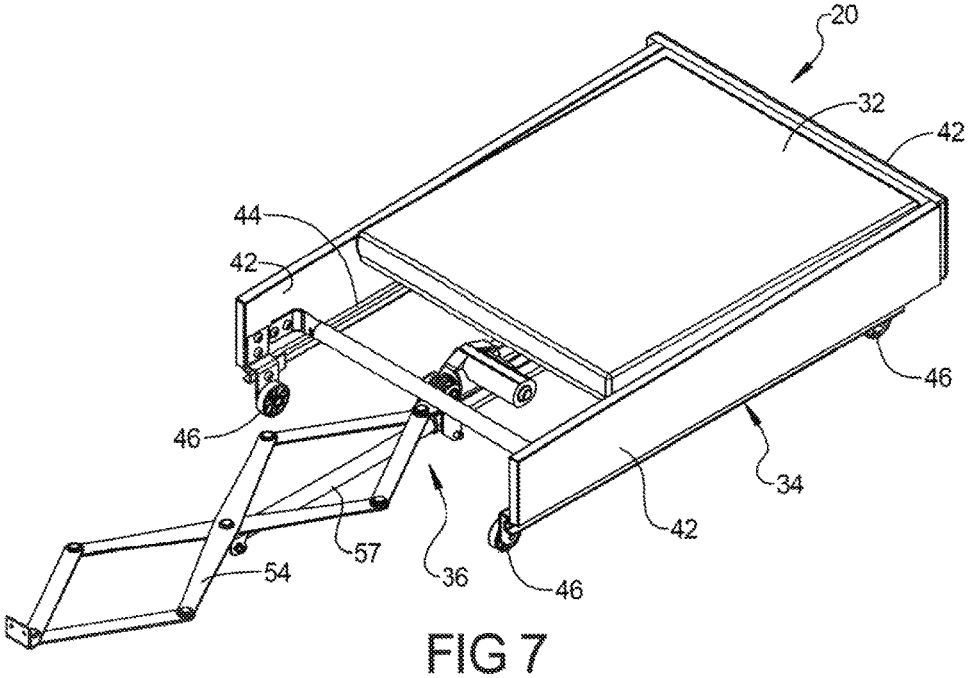
FIG. 7 is a perspective view of the ottoman assembly of FIG. 1 in an extended position.
Figure 8:
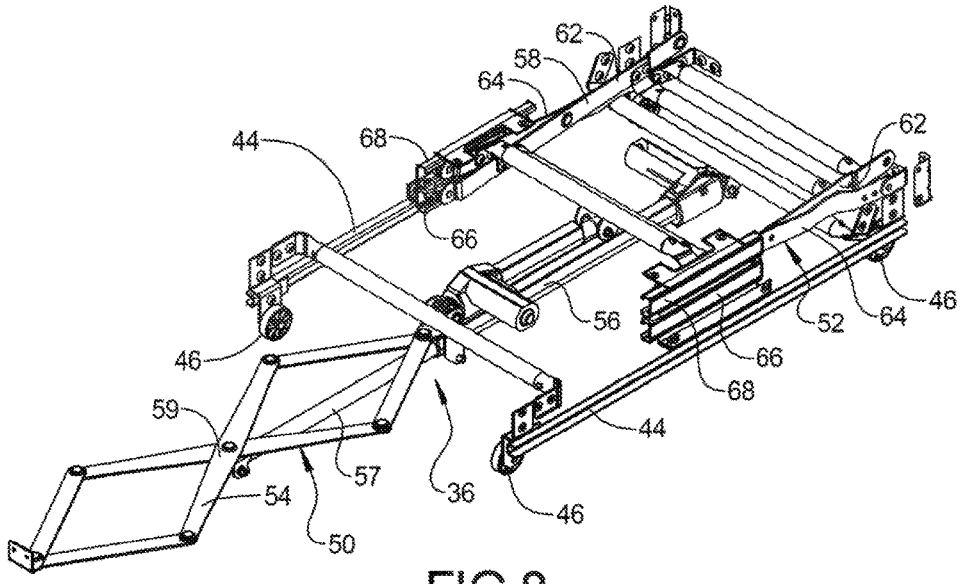
FIG. 8 is another perspective view of a portion of the ottoman assembly of FIG. 1 in the extended position.
Figure 10:
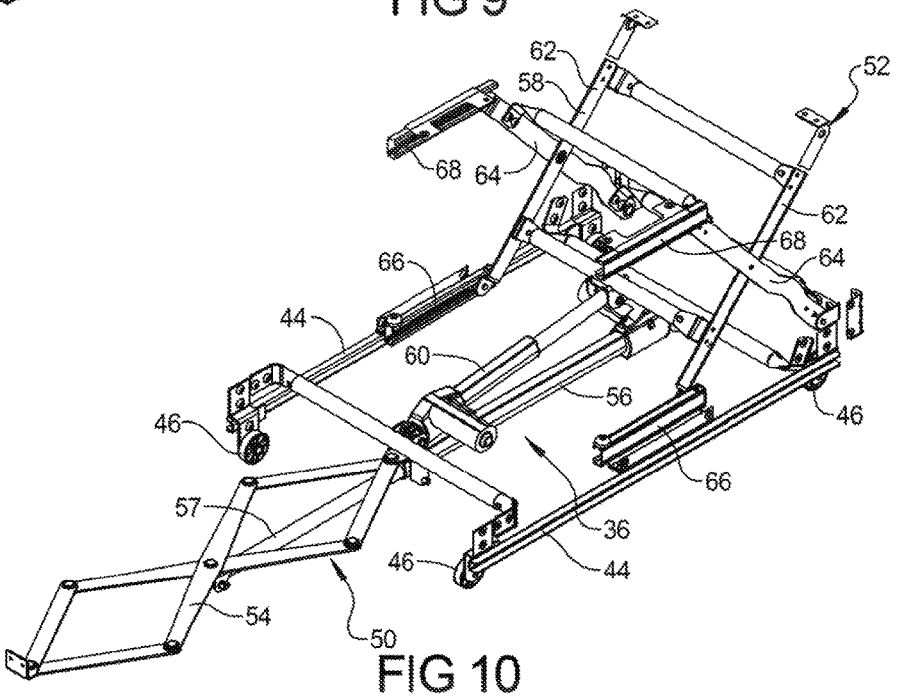
FIG. 10 is a perspective view of a portion of the ottoman assembly of FIG. 1 in the raised position.
Figure 11:
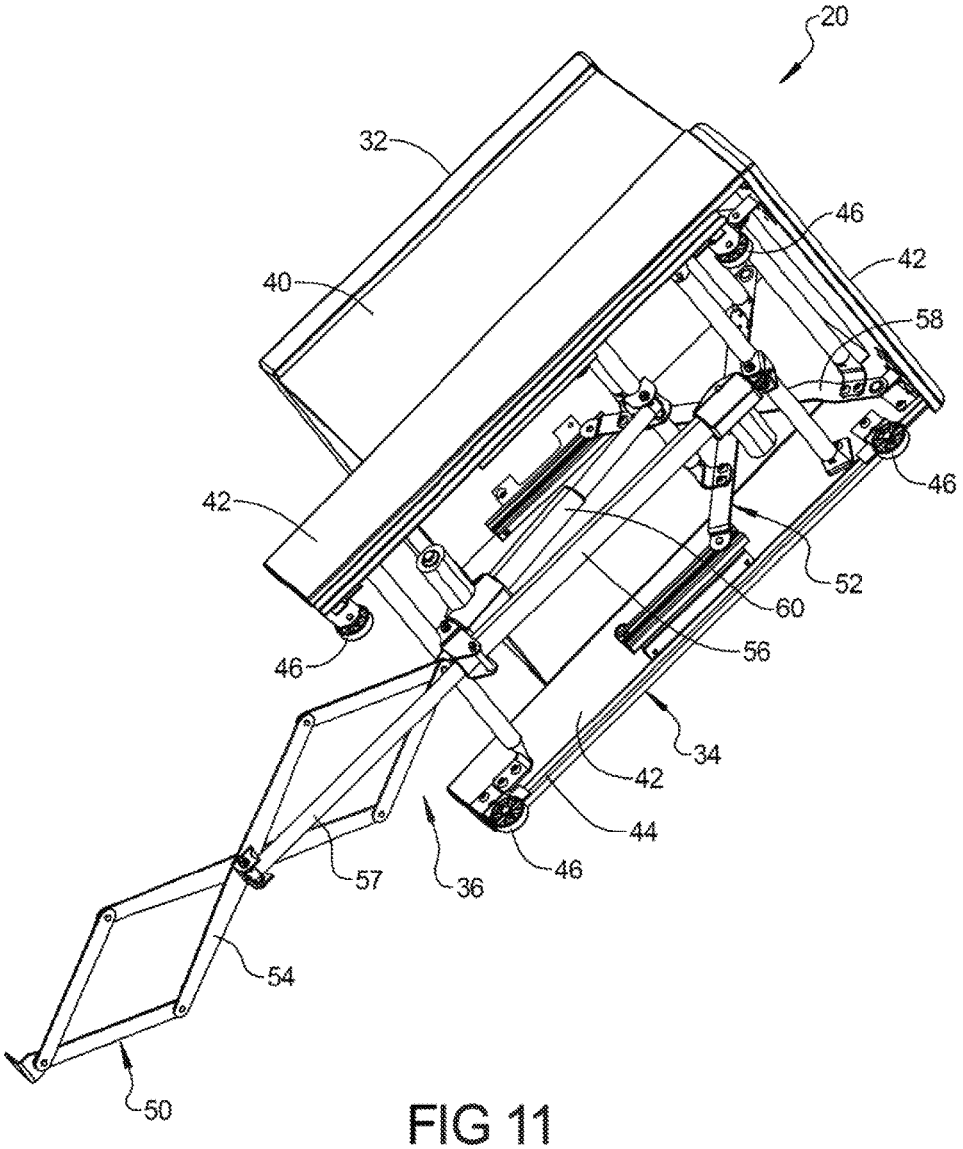
FIG. 11 is another perspective view of the ottoman assembly of FIG. 1 in the raised position.
Figure 12:
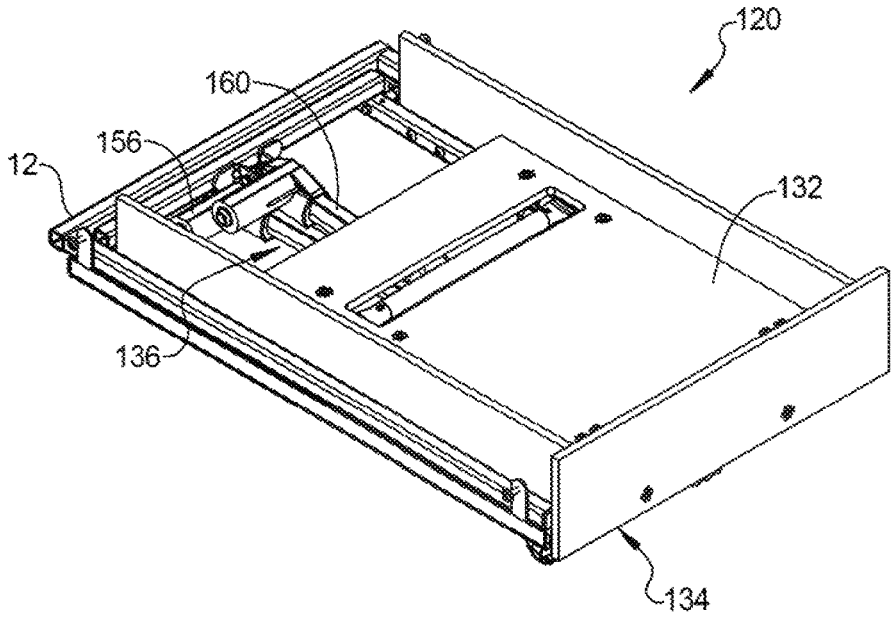
FIG. 12 is a perspective view of another ottoman assembly in a stowed position according to the principles of the present disclosure.
Figure 13:
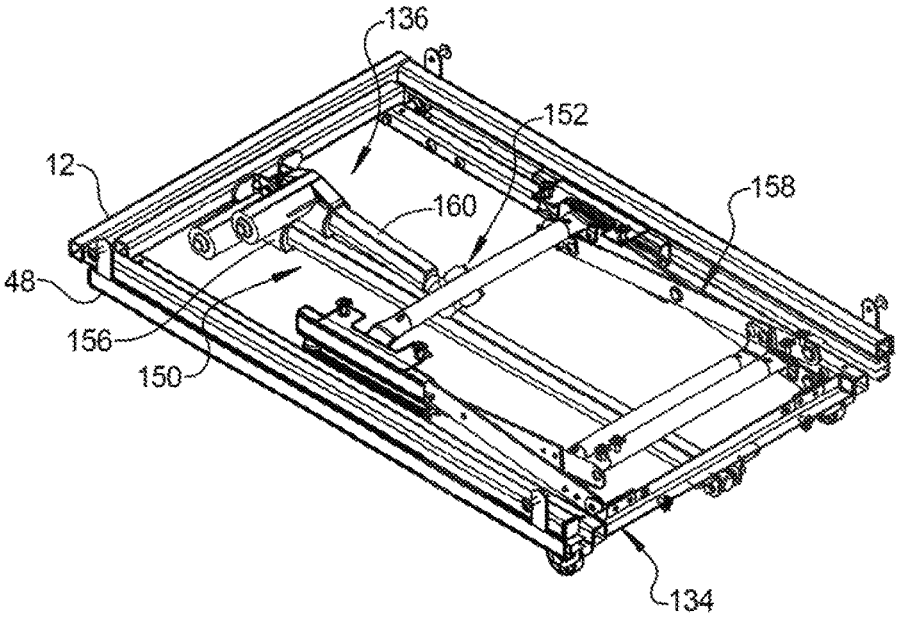
FIG. 13 is a perspective view of a portion of the ottoman assembly of FIG. 12 in the stowed position.
Figure 14:
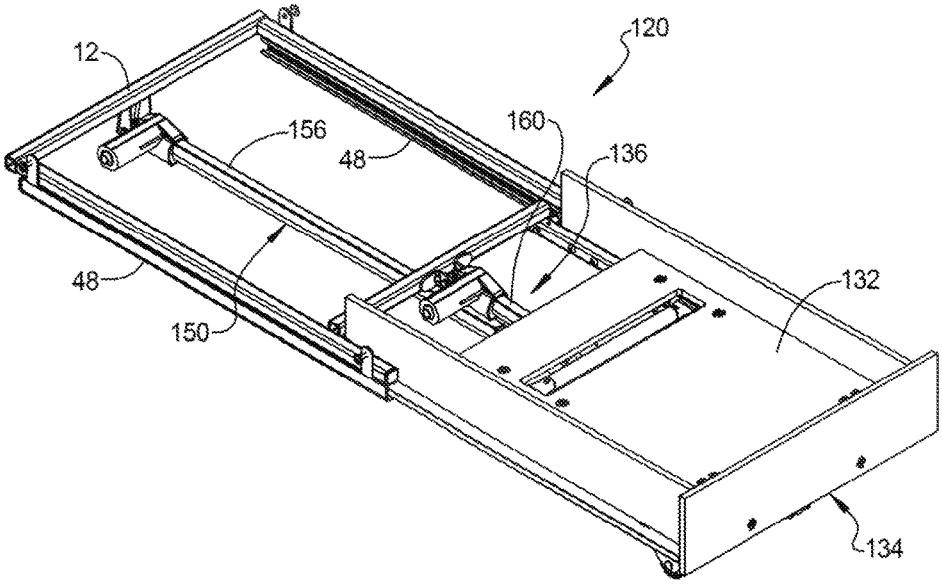
FIG. 14 is a perspective view of the ottoman assembly of FIG. 12 in an extended position.

The drive assembly 36 may include an extension mechanism 50 and a lift mechanism 52 (FIGS. 6, 8, and 10). The extension mechanism 50 may include a first scissor linkage 54 and a first motor-driven actuator 56. The first scissor linkage 54 may be mounted to the ottoman frame 34 and to the base frame 12. The first motor-driven actuator 56 may include a telescoping member 57 attached to the ottoman frame 34 and to a midpoint 59 (FIG. 8) of the first scissor linkage 54 such that actuation of the first motor-driven actuator 56 causes the first scissor linkage 54 to move the ottoman frame 34 and ottoman platform 32 relative to the base frame 12 between the stowed and extended positions (see FIGS. 2 and 4).

Figure 5:
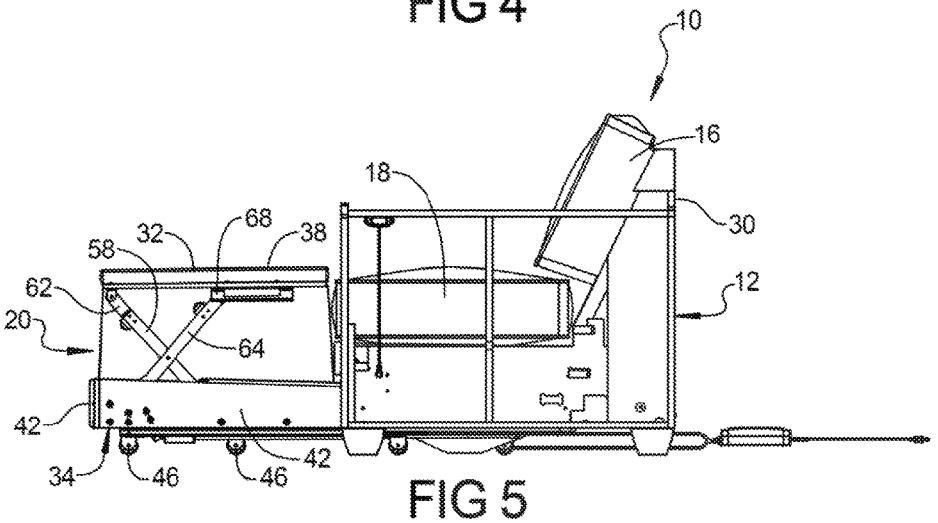
FIG. 5 is a side view of the portion of the furniture member of FIG. 1 with the ottoman assembly in the raised position.

The lift mechanism 52 may include a second scissor linkage 58 and a second motor-driven actuator 60. As shown in FIGS. 5, 8 and 10, the second scissor linkage 58 may include a first pair of links 62 and a second pair of links 64. The first pair of links 62 are fixedly attached to the ottoman platform 32 at one end and movably attached to third linear track members 66 at the other end. The third linear track members 66 are fixedly attached to the ottoman frame 34. The second pair of links 64 are fixedly attached to the ottoman frame 34 at one end and movably attached to fourth linear track members 68 at the other end. The fourth linear track members 68 are fixedly attached to the ottoman platform 32. The second motor-driven actuator 60 may be attached to the ottoman frame 34 and the second scissor linkage 58 such that actuation of the second motor-drive actuator 60 causes the second scissor linkage 58 to move the ottoman platform 32 relative to the ottoman frame 34 and the base frame 12 between the extended and raised positions (see FIGS. 7-11).

With continued reference to FIGS. 1-11, operation of the furniture member 10 will be described in detail. With the ottoman assembly 20 in the stowed position, a user may actuate the first motor-driven actuator 56 to cause the first track members 44 of the ottoman assembly 20 to move in a linear path along the second track members 48 of the base frame 12, thereby moving the ottoman assembly 20 horizontally in a linear path relative to the base frame 12 from the stowed position to the extended position.

Figure 3:
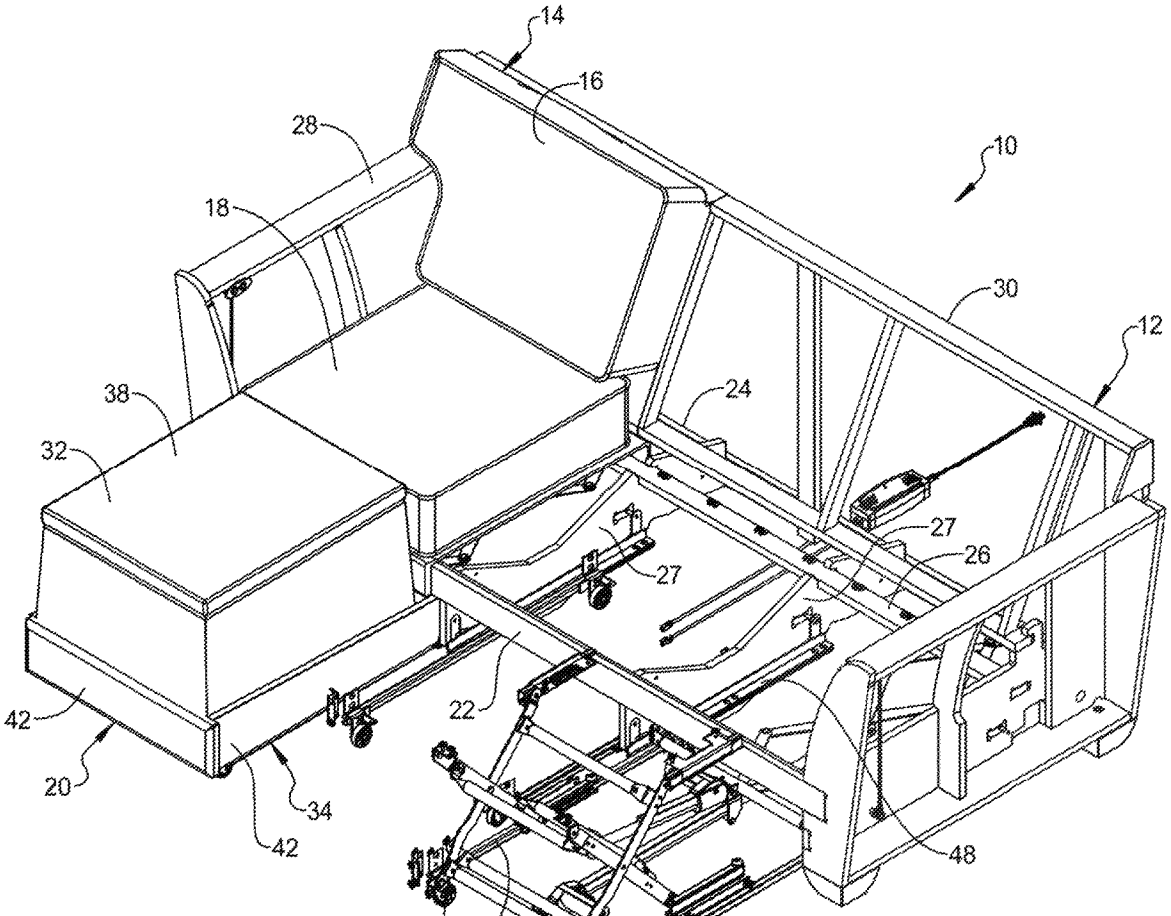
FIG. 3 is a perspective view of the portion of the furniture member of FIG. 1 with the ottoman assembly in a raised position according to the principles of the present disclosure.
Figure 4:
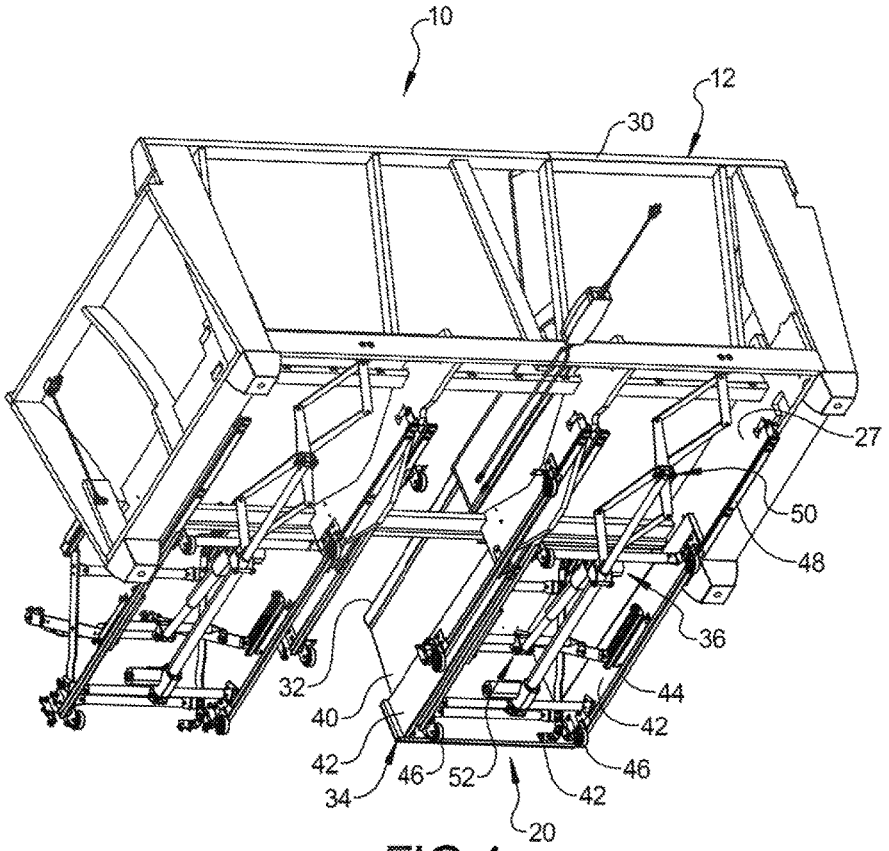
FIG. 4 is another perspective view of the portion of the furniture member of FIG. 1 with the ottoman assembly in the raised position.

With the ottoman assembly 20 in the extended position, the user may actuate the second motor-driven actuator 60 to cause the ottoman platform 32 to move vertically in a linear path from the extended position to the raised position. That is, actuation of the second motor-driven actuator 60 causes the first and second links 62, 64 to move relative to each other in a scissoring motion as the first links 62 move along the third track members 66 and the second links 64 move along the fourth track members 68. As shown in FIGS. 3 and 5, the top of the cushion of the ottoman platform 32 may be generally level with the top of the cushion of the seat bottom 18. Furthermore, as shown in FIG. 3, the shroud 40 may extend between the cushion of the ottoman platform 32 and the support members 42 of the ottoman frame 34 to block the user's view of and access to some or all of the drive assembly 36 and internal components of the ottoman frame 34. As shown in FIGS. 3 and 5, the furniture member 10 may have the general appearance of a chaise when the ottoman assembly 20 is in the raised position, as the ottoman cushion 38 is in close proximity to the seat bottom 18 such that there is no gap or a minimal gap between the seat bottom 18 and the ottoman cushion 38.

Figure 15:
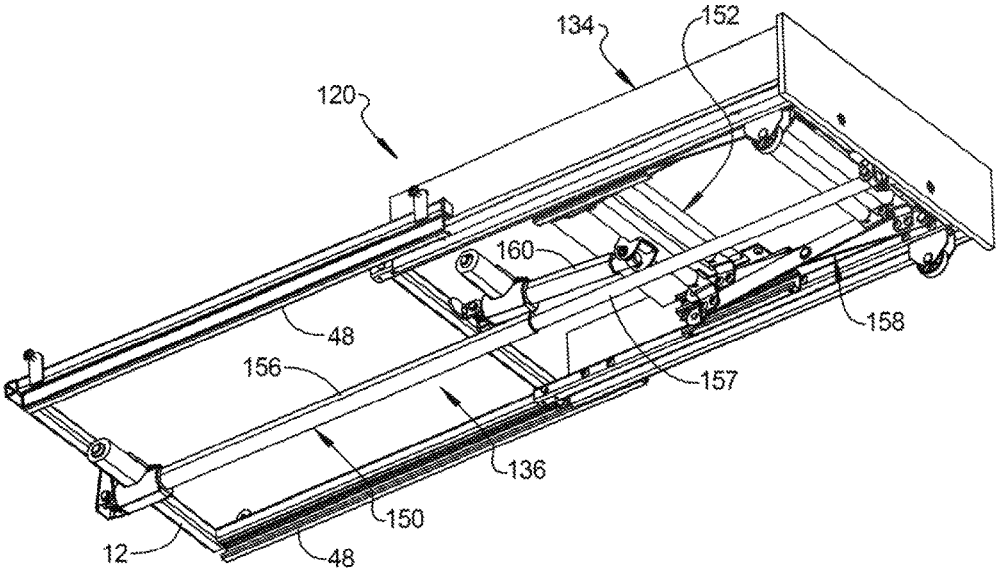
FIG. 15 is another perspective view of the ottoman assembly of FIG. 12 in an extended position.
Figure 16:
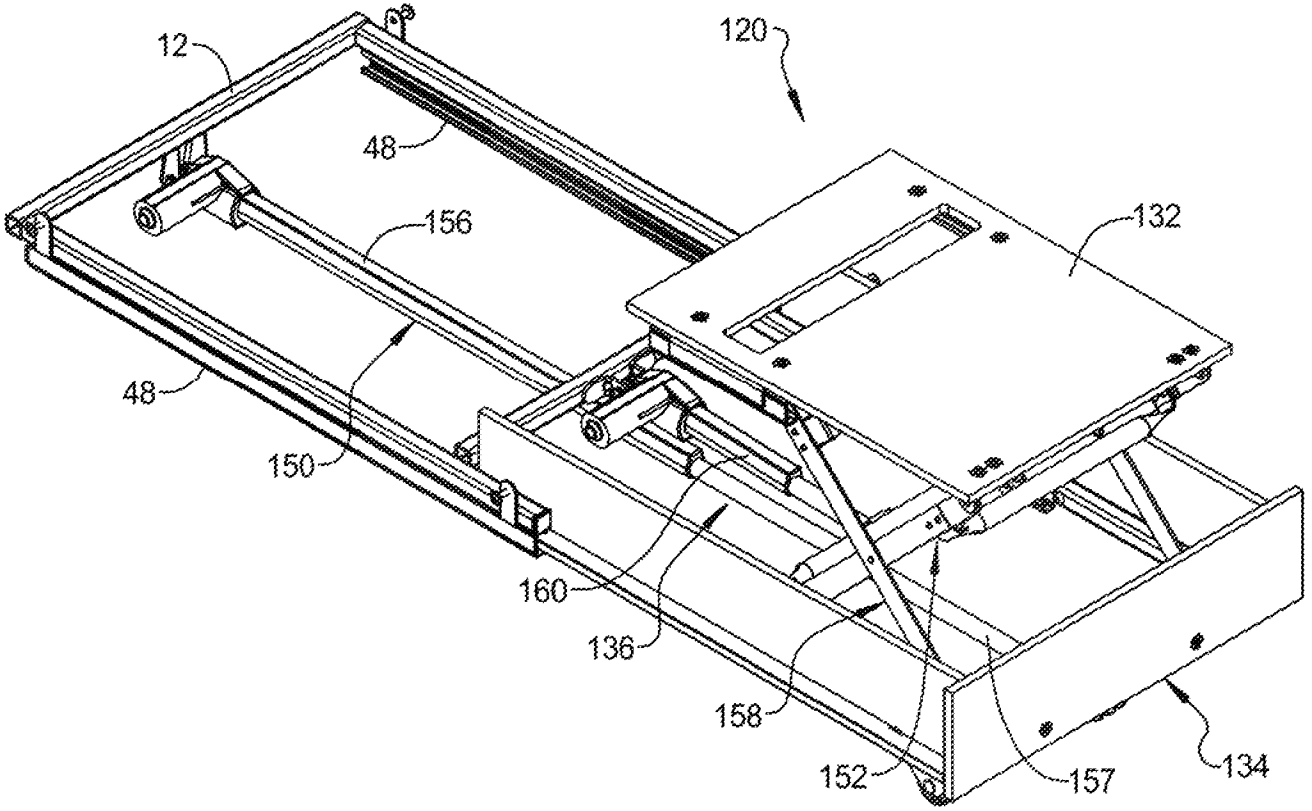
FIG. 16 is a perspective view of the ottoman assembly of FIG. 12 in a raised position.
Figure 17:
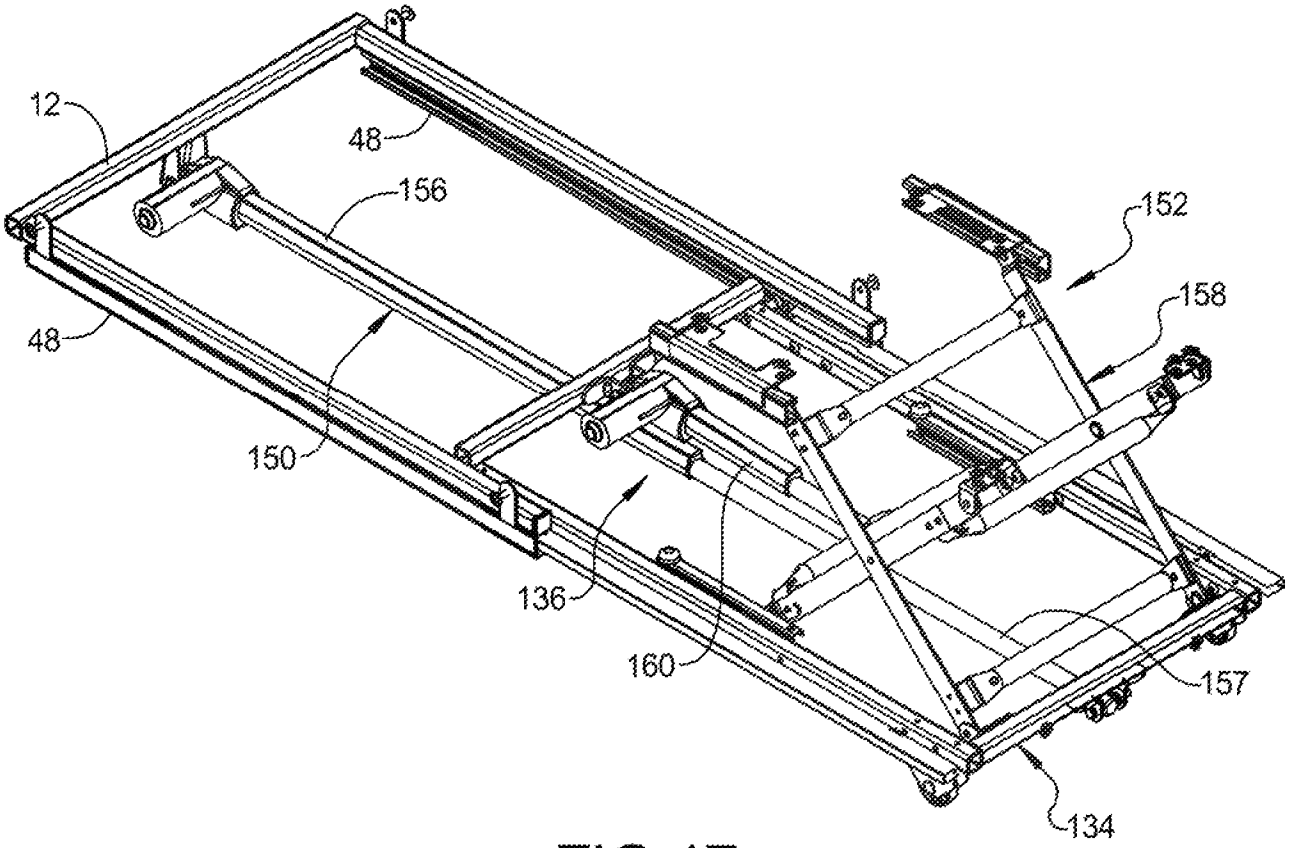
FIG. 17 is a perspective view of a portion of the ottoman assembly of FIG. 12 in the raised position.

With reference to FIGS. 12-17, another ottoman assembly 120 is provided that may be incorporated into the furniture member 10 instead of the ottoman assembly 20. Like the ottoman assembly 20, the ottoman assembly 120 may be movable relative to the base frame 12, the seatback 16 and the seat bottom 18 between a retracted or stowed position (FIGS. 12 and 13) and an extended position (FIGS. 14 and 15), and between the extended position and a raised position (FIGS. 16 and 17). The structure and function of the ottoman assembly 120 may be similar or identical to that of the ottoman assembly 20 described above, apart from any exceptions described below. Therefore, similar features may not be described again in detail.

Like the ottoman assembly 20, the ottoman assembly 120 may include an ottoman platform 132, an ottoman frame 134, and a drive assembly 136. The ottoman platform 132 and ottoman frame 134 may be similar or identical to the ottoman platform 32 and ottoman frame 34 described above. Like the drive assembly 36, the drive assembly 136 may include an extension mechanism 150 and a lift mechanism 152.

Unlike the extension mechanism 50, the extension mechanism 150 might not include the first scissor linkage 54. Rather, the extension mechanism 150 may include a first motor-driven actuator 156 having a telescoping member 157 (as shown in FIG. 15) that may be attached to the base frame 12 at one end and to the ottoman frame 134 at the other end. The stroke of the telescoping member 157 may span the entire range of movement of the ottoman frame 134.

The lift mechanism 152 may be similar or identical to the lift mechanism 52 described above. That is, the lift mechanism 152 may include a scissor linkage 158 and a second motor-driven actuator 160 (similar or identical to the second scissor linkage 58 and second motor-driven actuator 60). The first and second motor-driven actuators 156, 160 may both be centered under the seat bottom 18, and the second motor-driven actuator 160 may be positioned directly above the first motor-driven actuator 156 (i.e., the actuators 156, 160 may be aligned with each other in a vertical direction).

Figure 21:
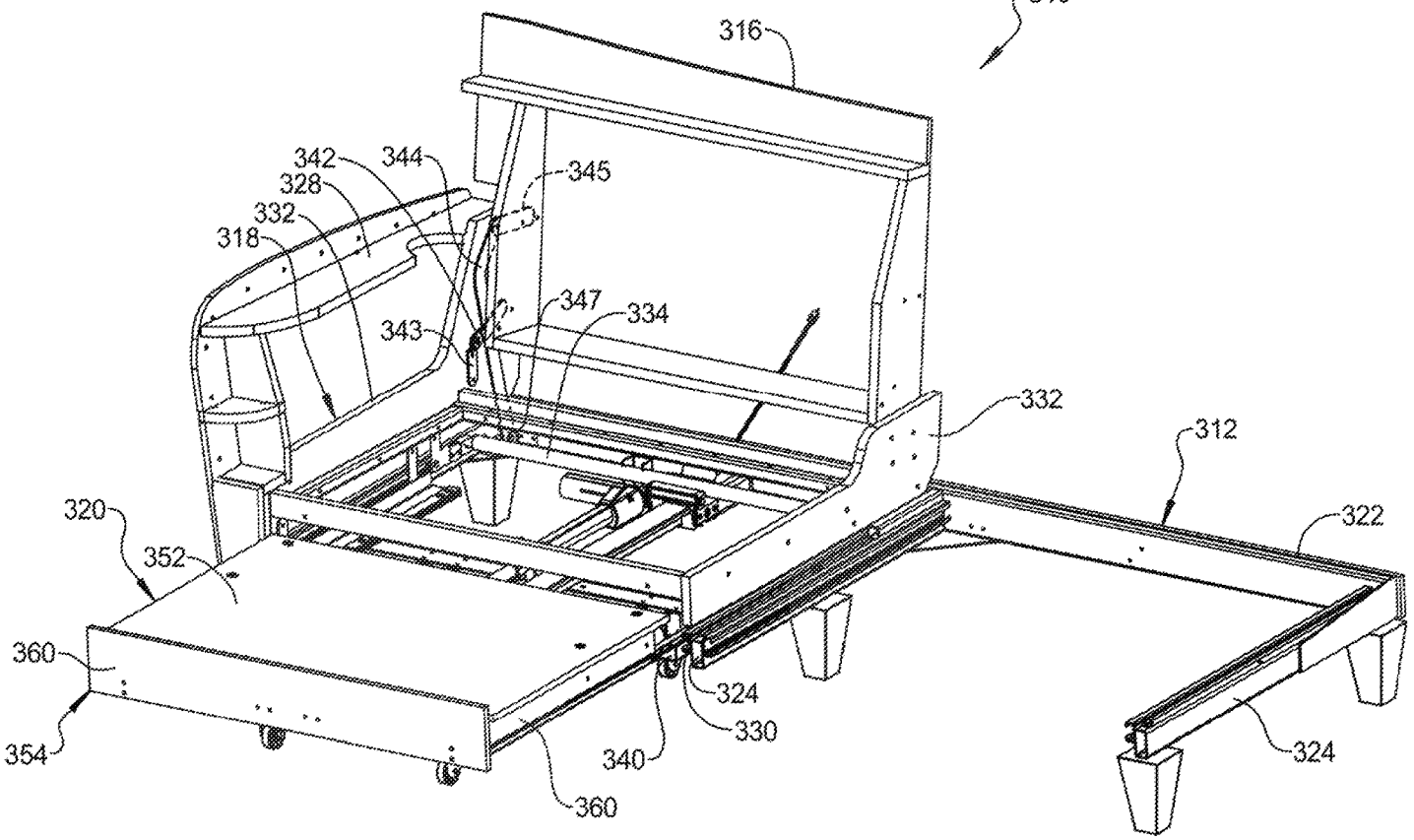
FIG. 21 is a perspective view of the portion of the furniture member of FIG. 18 with the seatback in the upright position and the ottoman assembly in an extended position.
Figure 22:
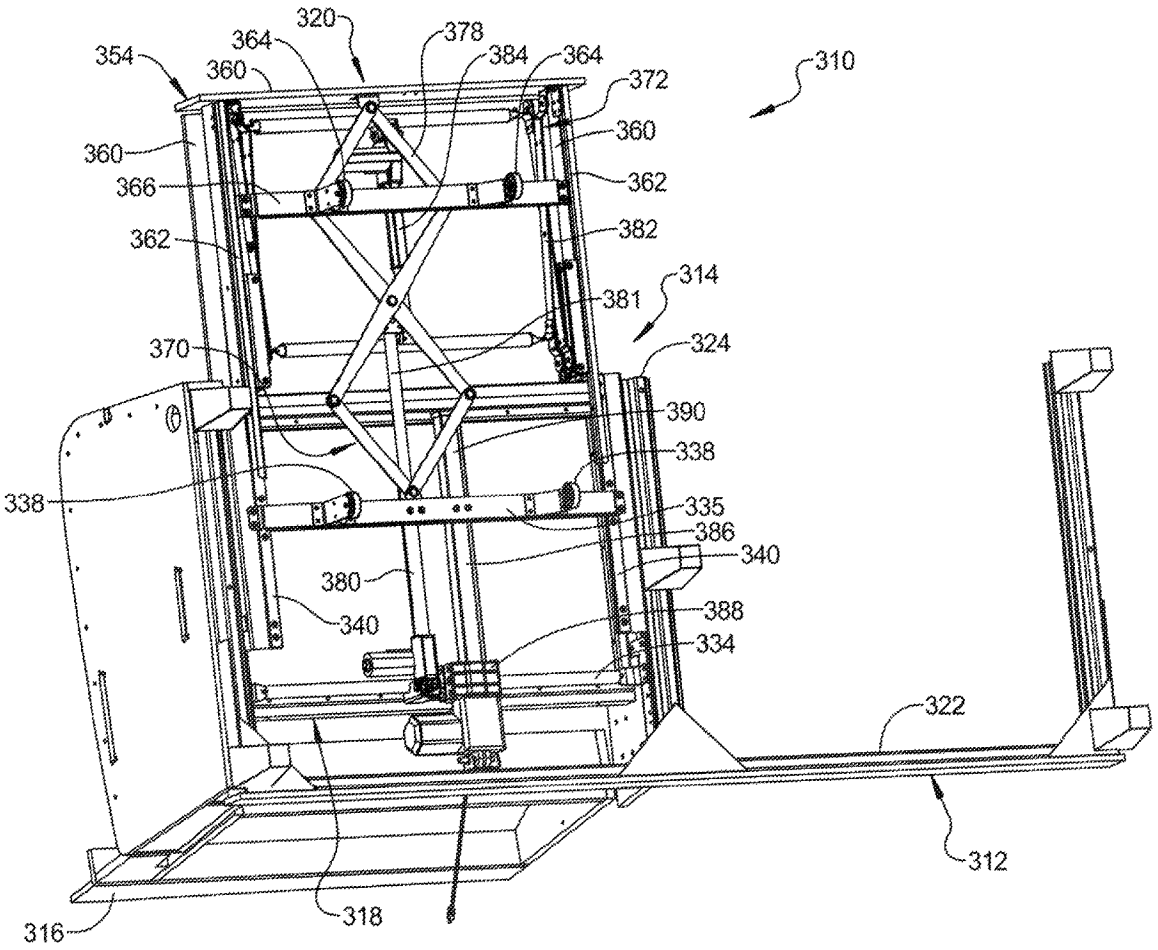
FIG. 22 is another perspective view of the portion of the furniture member of FIG. 18 with the seatback in the upright position and the ottoman assembly in the extended position.
Figure 23:
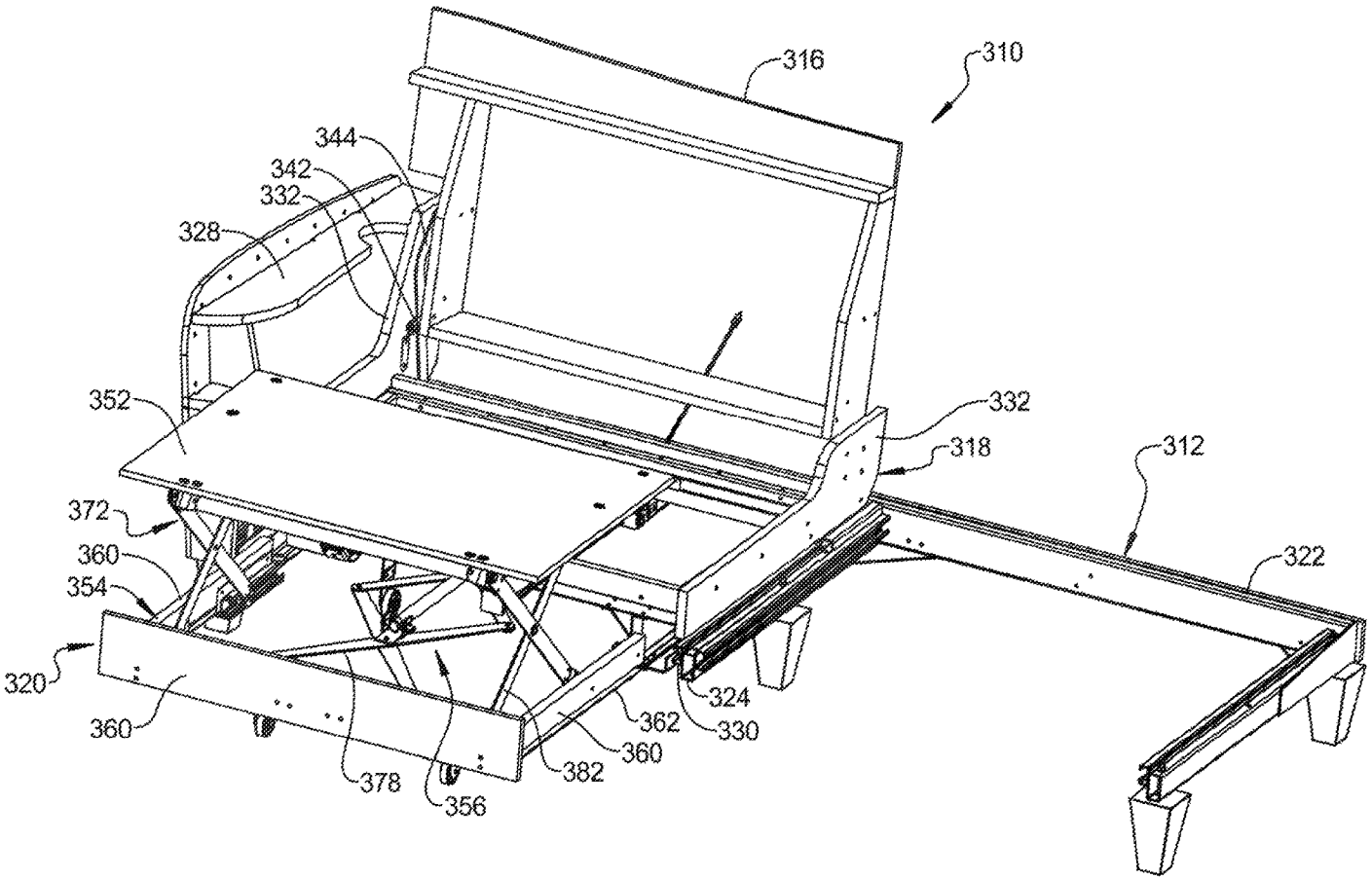
FIG. 23 is a perspective view of the portion of the furniture member of FIG. 18 with the seatback in the upright position and the ottoman assembly in a raised position.
Figure 24:
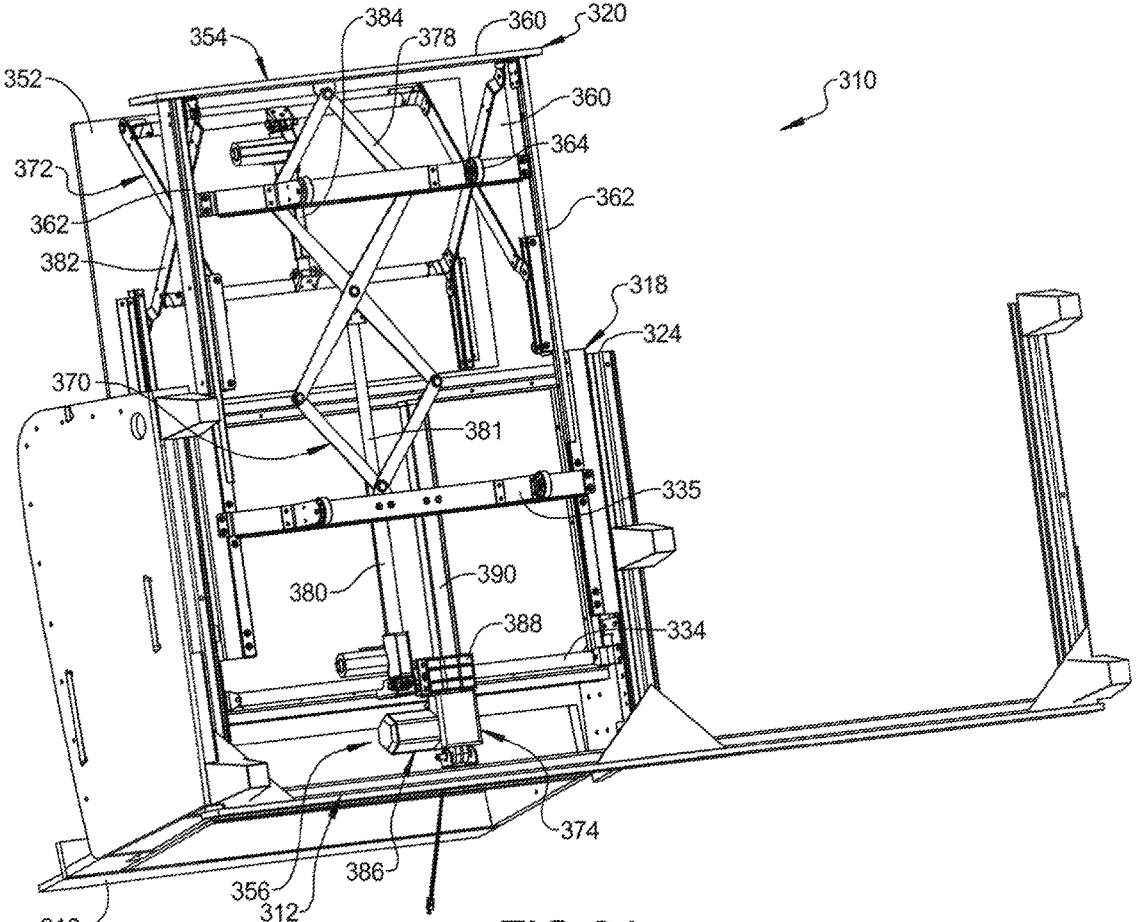
FIG. 24 is another perspective view of the portion of the furniture member of FIG. 18 with the seatback in the upright position and the ottoman assembly in the raised position.
Figure 25:
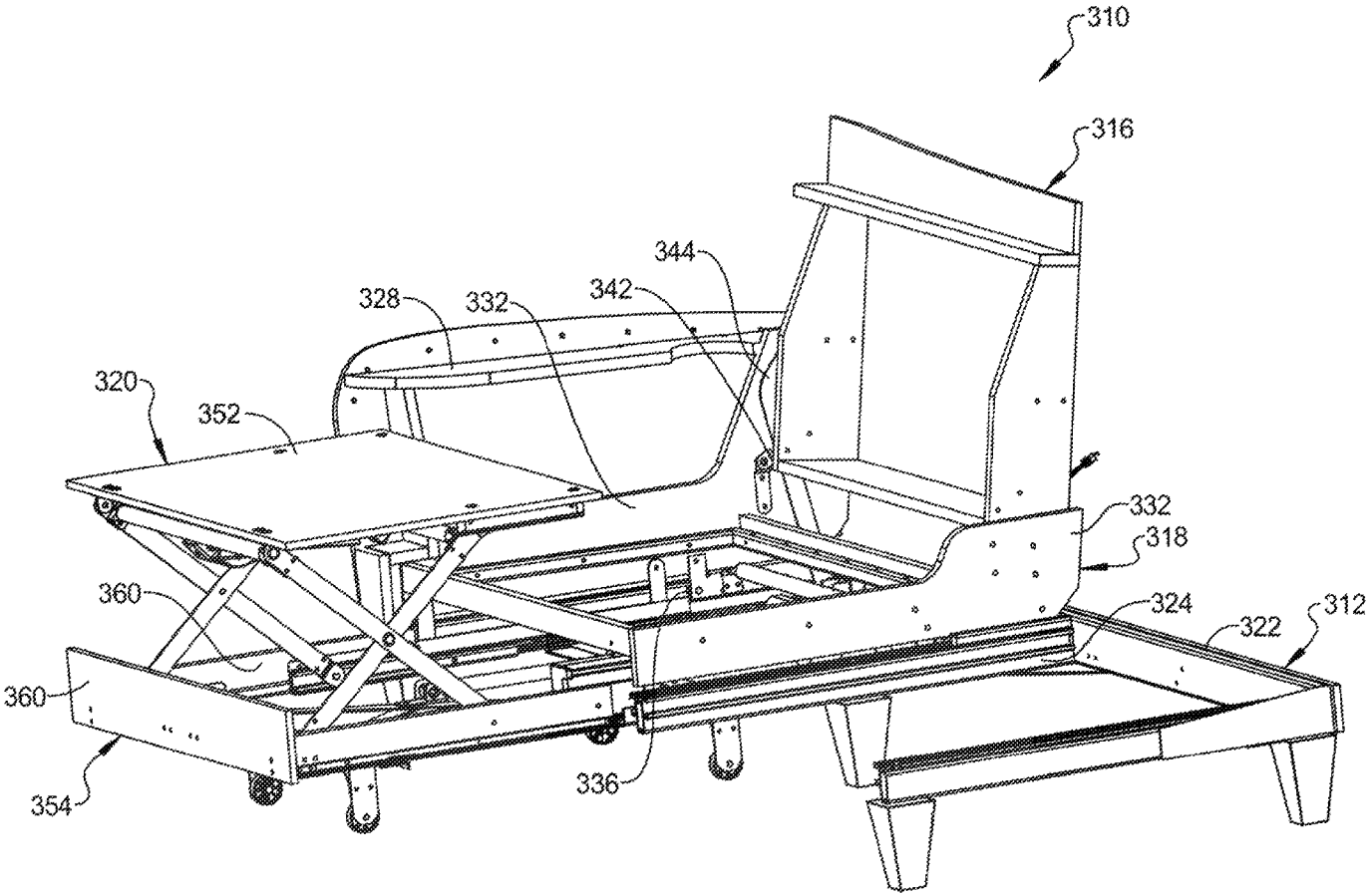
FIG. 25 is yet another perspective view of the portion of the furniture member of FIG. 18 with the seatback in the upright position and the ottoman assembly in the raised position.
Figure 26:
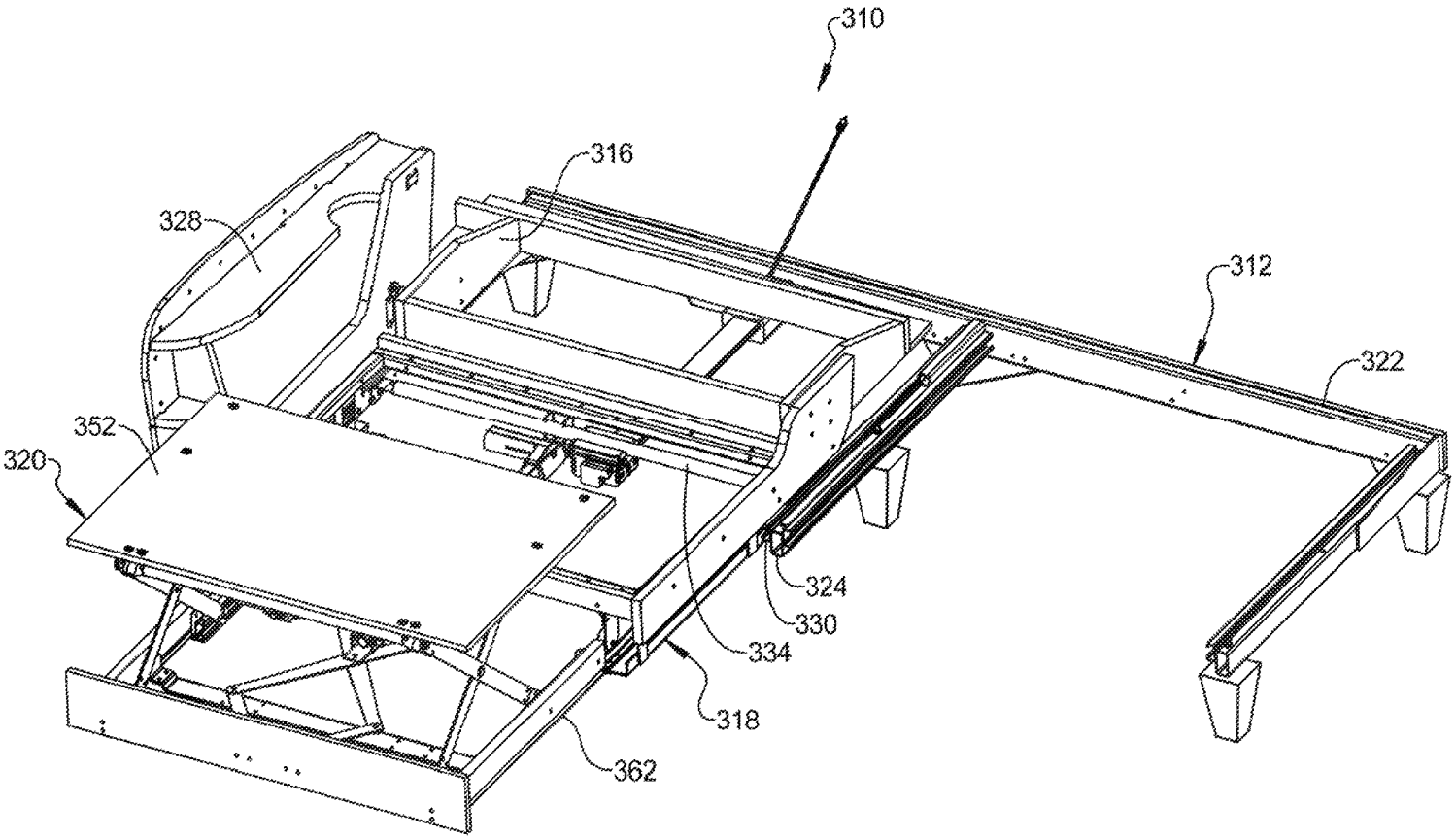
FIG. 26 is a perspective view of the portion of the furniture member of FIG. 18 with the seatback in a sleeper position and the ottoman assembly in a sleeper position.

With reference to FIGS. 18-29, another furniture member 310 is provided that may include a base frame 312 and one or more seat assemblies 314 (only one of which is shown in the figures). Each seat assembly 314 includes a seatback 316, a seat bottom 318, and an ottoman assembly 320. The base frame 312 may be a stationary construction and may support the seatback 316, the seat bottom 318 and the ottoman assembly 320. The seatback 316, seat bottom 318 and ottoman assembly 320 are movable relative to each other and the base frame 312. As will be described in more detail below, the ottoman assembly 320 is movable relative to the base frame 312, the seatback 316 and the seat bottom 318 between a retracted or stowed position (FIGS. 18-20) and an extended position (FIGS. 21 and 22), between the extended position and a raised position (FIGS. 23-25). Furthermore, the seatback 316 and the seat bottom 318 are movable relative to the base frame 312 between an upright position (FIGS. 18-25) and a sleeper position (FIGS. 26-29). The ottoman assembly 320 moves with the seat bottom 318 relative to the base frame 312 and seatback 316 as the seat bottom 318 moves between the upright and sleeper positions.

The base frame 312 may include a cross member 322 and a plurality of fore-aft support members 324. Each of the support members 324 may include a linear first track member 330 that extends from an aft end of the furniture member 310 to a front end of the furniture member 310.

The seat bottom 318 may include a frame having a pair of fore-aft frame members 332 and rear and center cross members 334, 335 (FIGS. 20-26 and 28) extending between and are fixed relative to the fore-aft frame members 332. An armrest 328 may be fixedly attached to one of the frame members 332. Each of the frame members 332 may include one or more rollers 336 (FIG. 25) that rollingly engage a corresponding one of the first track members 330. The center cross member 335 may include a plurality of wheels or rollers 338 (FIGS. 20 and 22) that roll along the floor or ground surface. Each of the frame members 332 may also include a second track member 340 (FIG. 22) that slidably or rollingly engages the ottoman assembly 320.

Figure 18:
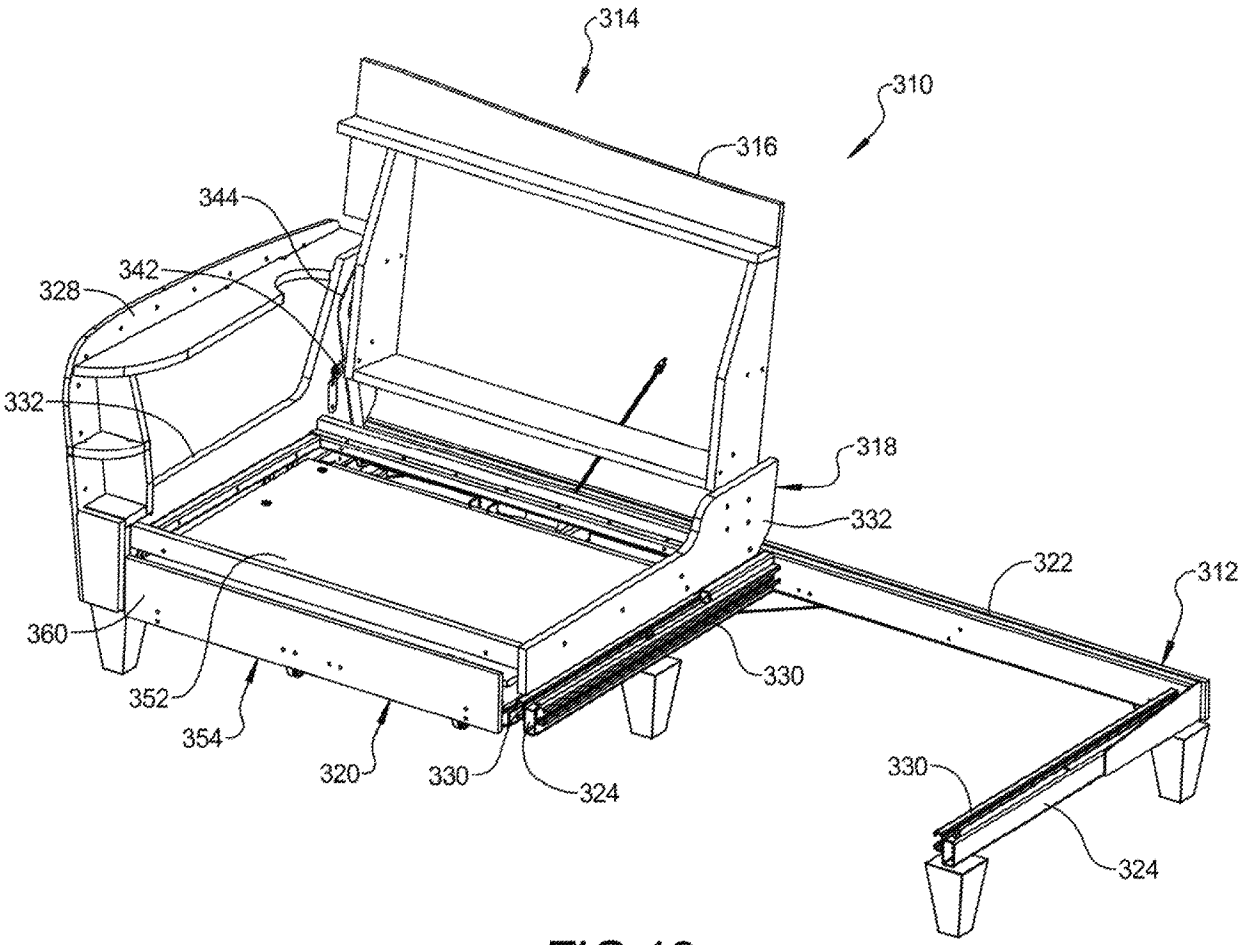
FIG. 18 is a perspective view of a portion of another furniture member having a seatback in an upright position and an ottoman assembly in a stowed position according to the principles of the present disclosure.

The seatback 316 may be rotatably coupled to the seat bottom 318 by a pair of first links 342 (FIGS. 18, 21 and 25). One end of each of the first links 342 may be fixedly attached to the seatback 316 and another end of each of the first links 342 may be rotatably attached to a first bracket 343 (FIG. 21) that is fixed to the seat bottom 318. The seatback 316 may also be rotatably coupled to the base frame 312 by a pair of second links 344 (FIGS. 18, 21 and 25). One end of each of the second links 344 may be rotatably coupled to a second bracket 345 (FIG. 21) that is fixed to the seatback 316 and another end of each of the second links 344 may be rotatably coupled to a third bracket 347 (FIG. 21) fixed to the cross member 322 of the base frame 312. The first and second links 342, 344 allow the seatback 316 to rotate relative to the seat bottom 318 and the base frame 312 between the upright and sleeper positions.

The ottoman assembly 320 may be generally similar to either of the ottoman assemblies 20, 120 described above. That is, the ottoman assembly 320 may include an ottoman platform 352, an ottoman frame 354, and a drive assembly 356. The ottoman platform 352 may include an upholstered cushion 358 (FIG. 27) and a shroud (not shown; like the shroud 40) that extends downward from three or four sides of the cushion 358 to block a user's view of the drive assembly 356 when the ottoman platform 352 is in the raised and sleeper positions.

As shown in FIG. 22, the ottoman frame 354 may include a plurality of support members 360, a pair of linear third track members 362 fixed to corresponding support members 360, and a plurality of wheels or rollers 364 attached to a cross member 366. Each of the third track members 362 may slidably (or rollingly) engage a corresponding one of the second track members 340 on the seat bottom 318 to allow the ottoman frame 354 and ottoman platform 352 to move horizontally relative to the seat bottom 318 between the stowed and extended positions.

Figure 28:
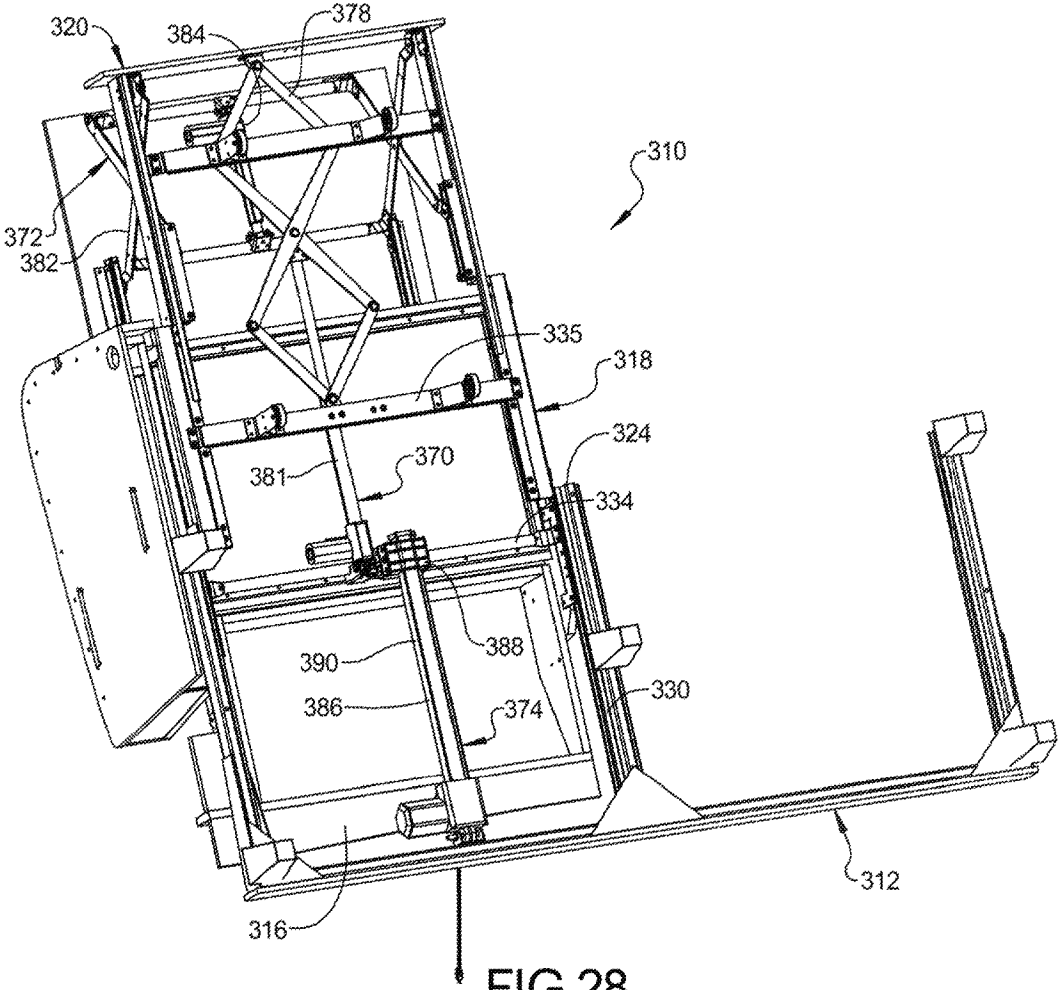
FIG. 28 is another perspective view of the portion of the furniture member of FIG. 18 with the seatback in the sleeper position and the ottoman assembly in the sleeper position.
Figure 29:
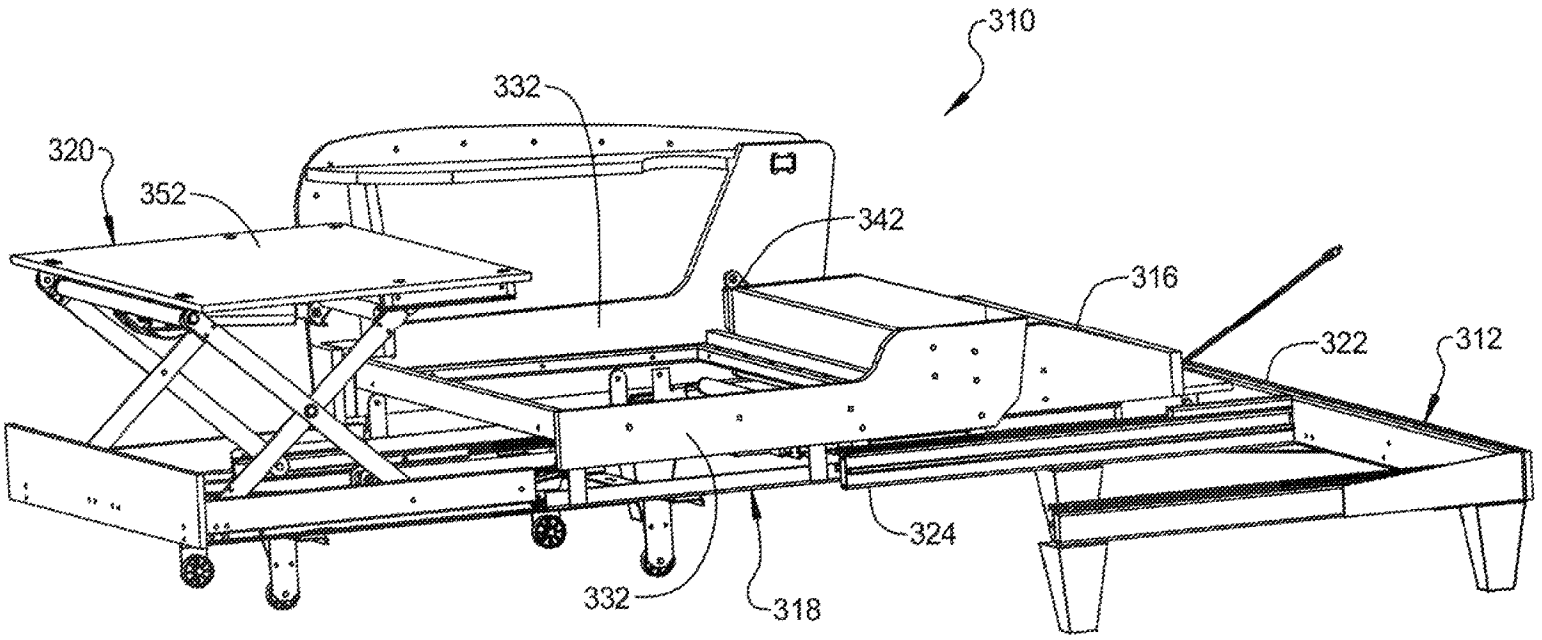
FIG. 29 is yet another perspective view of the portion of the furniture member of FIG. 18 with the seatback in the sleeper position and the ottoman assembly in the sleeper position.
Figure 30:
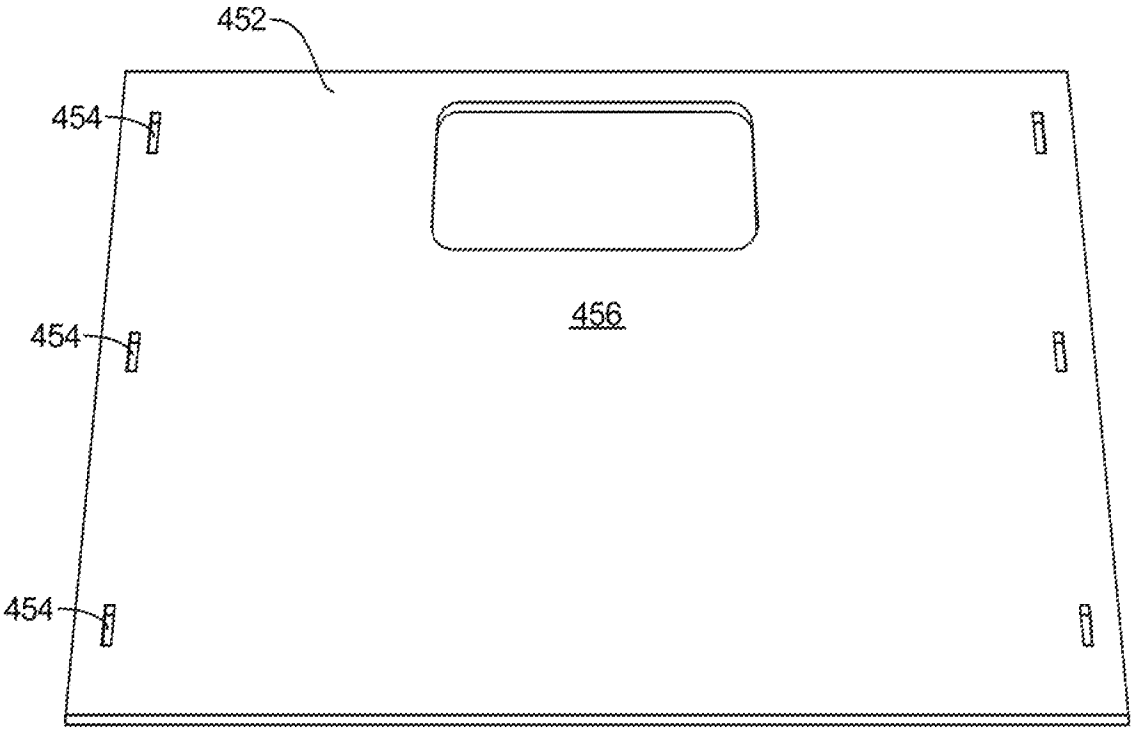
FIG. 30 is a perspective view of an ottoman platform according to the principles of the present disclosure.

As shown in FIGS. 24 and 28, the drive assembly 356 may include an extension mechanism 370, a lift mechanism 372, and a sleeper mechanism 374. The extension mechanism 370 may be similar or identical to the extension mechanism 50 described above. That is, the extension mechanism 370 may include a first scissor linkage 378 and a first motor-driven actuator 380. The first scissor linkage 378 may be mounted to the ottoman frame 354 and to the cross member 335. The first motor-driven actuator 380 may include a telescoping member 381 attached to the cross member 334 and to the first scissor linkage 378 such that actuation of the first motor-driven actuator 380 causes the first scissor linkage 378 to move the ottoman frame 354 and ottoman platform 352 relative to the seat bottom 318 and base frame 312 between the stowed and extended positions.

In some configurations, the extension mechanism 370 may be similar or identical to the extension mechanism 150 described above. That is, the extension mechanism 370 might not include the first scissor linkage 378. Rather, the first motor-driven actuator 380 may be attached to the cross member 334 at one end and to the ottoman frame 354 at the other end. The stroke of the telescoping member 381 may span the entire range of movement of the ottoman frame 354.

The lift mechanism 372 may be similar or identical to the lift mechanism 52 described above, and therefore, will not be described again in detail. Briefly, the lift mechanism 372 may include a second scissor linkage 382 and a second motor-driven actuator 384. The second motor-driven actuator 384 may be attached to the ottoman frame 354 and the second scissor linkage 382 such that actuation of the second motor-drive actuator 384 causes the second scissor linkage 382 to move the ottoman platform 352 relative to the ottoman frame 354 and the seat bottom 318 between the extended and raised positions.

As shown in FIGS. 24 and 28, the sleeper mechanism 374 may include a third motor-driven actuator 386 including a slide member 388 and a track 390. The third motor-driven actuator 386 is pivotably attached to the base frame 312. The slide member 388 is slidably attached to the track 390 and is fixedly attached to the cross member 334 of the seat bottom 318. In this manner, actuation of the third motor-driven actuator 386 causes the slide member 388 to move along the track 390, thereby causing the seat bottom 318 to move horizontally relative to the base frame 312.

In some configurations, the first and second motor-driven actuators 380, 384 may both be centered under the seat bottom 318, and the second motor-driven actuator 384 may be positioned directly above the first motor-driven actuator 380 (i.e., the actuators 380, 384 may be aligned with each other in a vertical direction). The third motor-driven actuator 386 may be positioned beside the first motor-driven actuator 380 such that the third motor-driven actuator 386 is off-center relative to the seat bottom 318. In other configurations, the actuators 380, 384 may be off-center relative to the seat bottom 318, and the third motor-driven actuator 386 may be centered relative to the seat bottom 318.

With continued reference to FIGS. 18-29, operation of the furniture member 310 will be described in detail. With the ottoman assembly 320 in the stowed position (FIGS. 18-20), a user may actuate the first motor-driven actuator 380 to cause the third track members 362 of the ottoman assembly 320 to move in a linear path along the second track members 340 of the seat bottom 318, thereby moving the ottoman assembly 320 horizontally in a linear path relative to the seat bottom 318 and the base frame 12 from the stowed position to the extended position (FIGS. 21 and 22).

With the ottoman assembly 320 in the extended position, the user may actuate the second motor-driven actuator 384 to cause the ottoman platform 352 to move vertically in a linear path from the extended position to the raised position (FIGS. 23-25). That is, actuation of the second motor-driven actuator 384 causes movement of the second scissor linkage 382 to raise the ottoman platform 352 in the manner described above.

With the ottoman assembly 320 in the raised position, the user may actuate the third motor-driven actuator 386 to cause move the ottoman assembly 320 horizontally further away from the stowed position while simultaneously moving the seat bottom 318 and seatback 316 from the upright position to the sleeper position (FIGS. 26-29). That is, actuation of the third motor-driven actuator 386 causes the slide member 388 to move along the track 390. Because the slide member 388 is fixed to the cross member 334 of the seat bottom 318, movement of the slide member 388 along the track 390 causes corresponding movement of the seat bottom 318 relative to the base frame 312 (i.e., via the movable engagement between the rollers 336 of the seat bottom 318 and the first track member 330 of the base frame 312).

Figure 27:
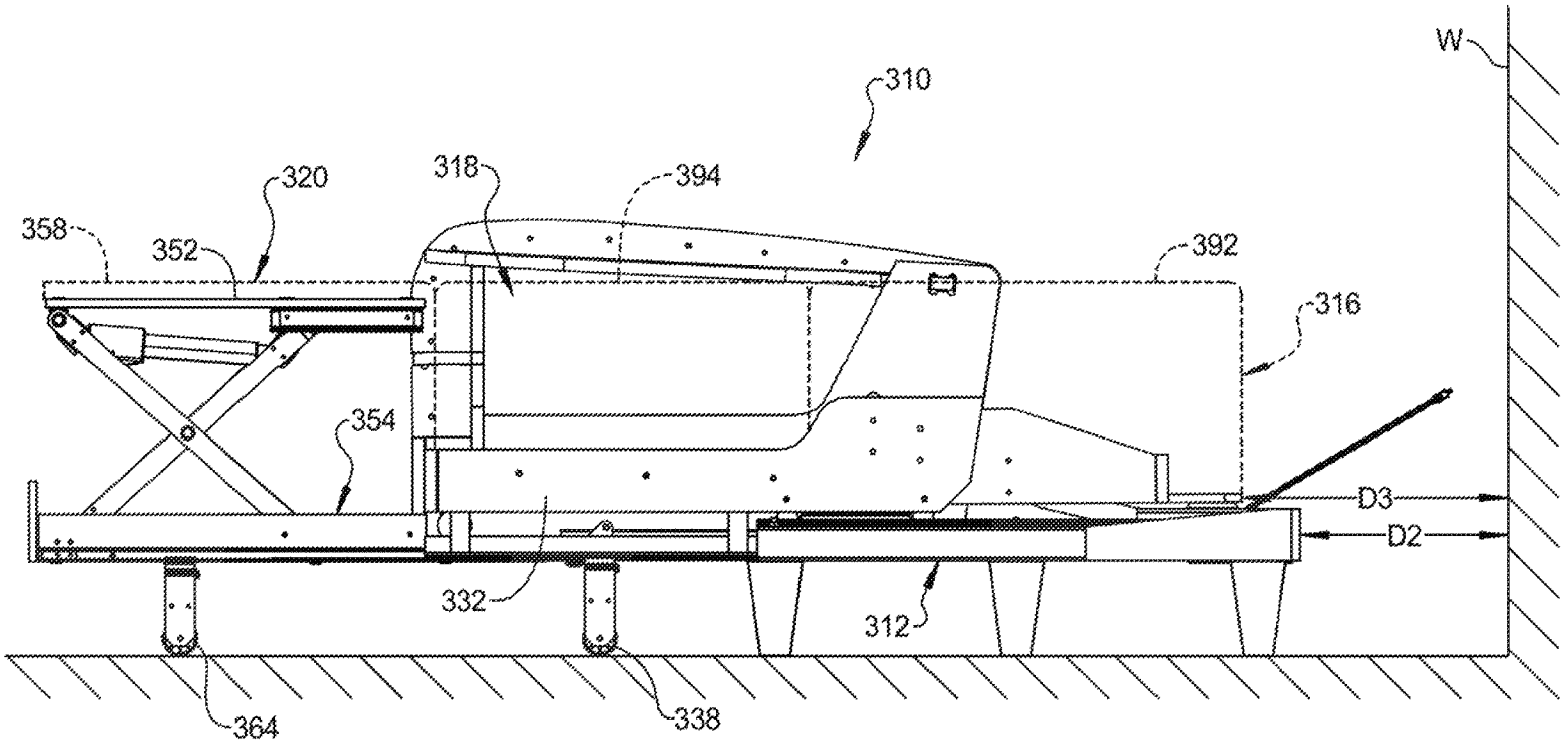
FIG. 27 is a side view of the portion of the furniture member of FIG. 18 with the seatback in the sleeper position and the ottoman assembly in the sleeper position.

Such horizontal motion of the seat bottom 318 relative to the base frame 312 causes corresponding rotation of the seatback 316 relative to the seat bottom 318 and the base frame 312. Because the first links 342 (FIG. 25) are attached to the seatback 316 and the seat bottom 318, forward horizontal movement of the seat bottom 318 causes the seatback 316 to rotate and translate into the sleeper position. That is, the seatback 316 rotates into a horizontal position while the lower end of the seatback 316 (i.e., the end adjacent the seat bottom) translates forward as the seat bottom 318 and ottoman assembly 320 translate forward. In the sleeper position, a seatback cushion 392 (shown schematically in FIG. 27), a seat bottom cushion 394 (shown schematically in FIG. 27) and the ottoman cushion 358 (shown schematically in FIG. 27) cooperate to form a generally flat, horizontal sleep surface (i.e., a surface upon which a user can lay generally flat), as shown in FIG. 27. In the sleeper position, the seat bottom cushion 394 may be directly adjacent to the cushions 392, 358 with little or no space therebetween. In some configurations, the sleep surface defined by the cushions 358, 392, 394 may be about seventy-two inches or more in length. It will be appreciated that in some configurations, one or more of the cushions 392, 394, 358 may be contoured such that the horizontal sleep surface formed by the cushions 392, 294, 358 might not be a completely flat surface. Furthermore, for purposes of the present disclosure, the term "horizontal sleep surface" should be construed to include surfaces that are: (1) completely flat or contoured, and (2) parallel to the ground or within about 10-15 degrees out of parallel with the ground (e.g., with some or all of the seatback cushion 392 or the ottoman cushion 358 being 10-15 degrees above or below parallel with the ground).

Figure 19:
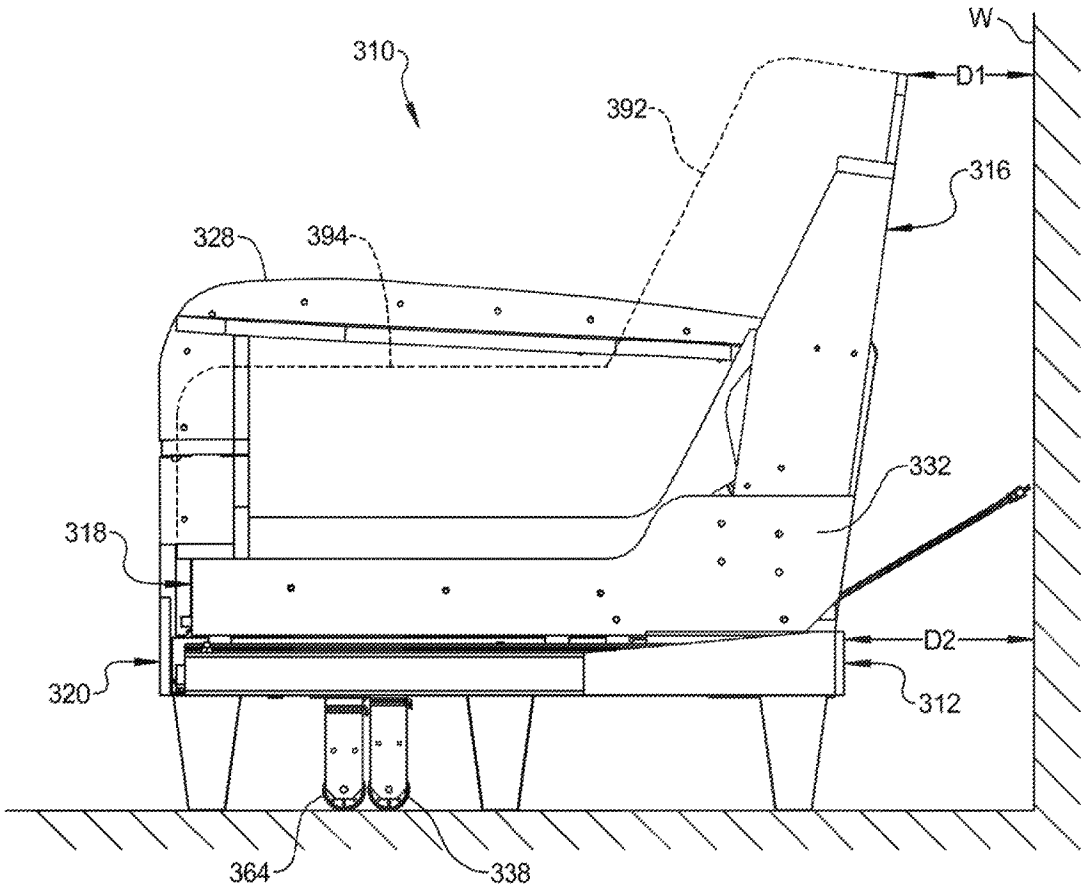
FIG. 19 is a side view of the portion of the furniture member of FIG. 18 with the seatback in the upright position and the ottoman assembly in the stowed position.
Figure 20:
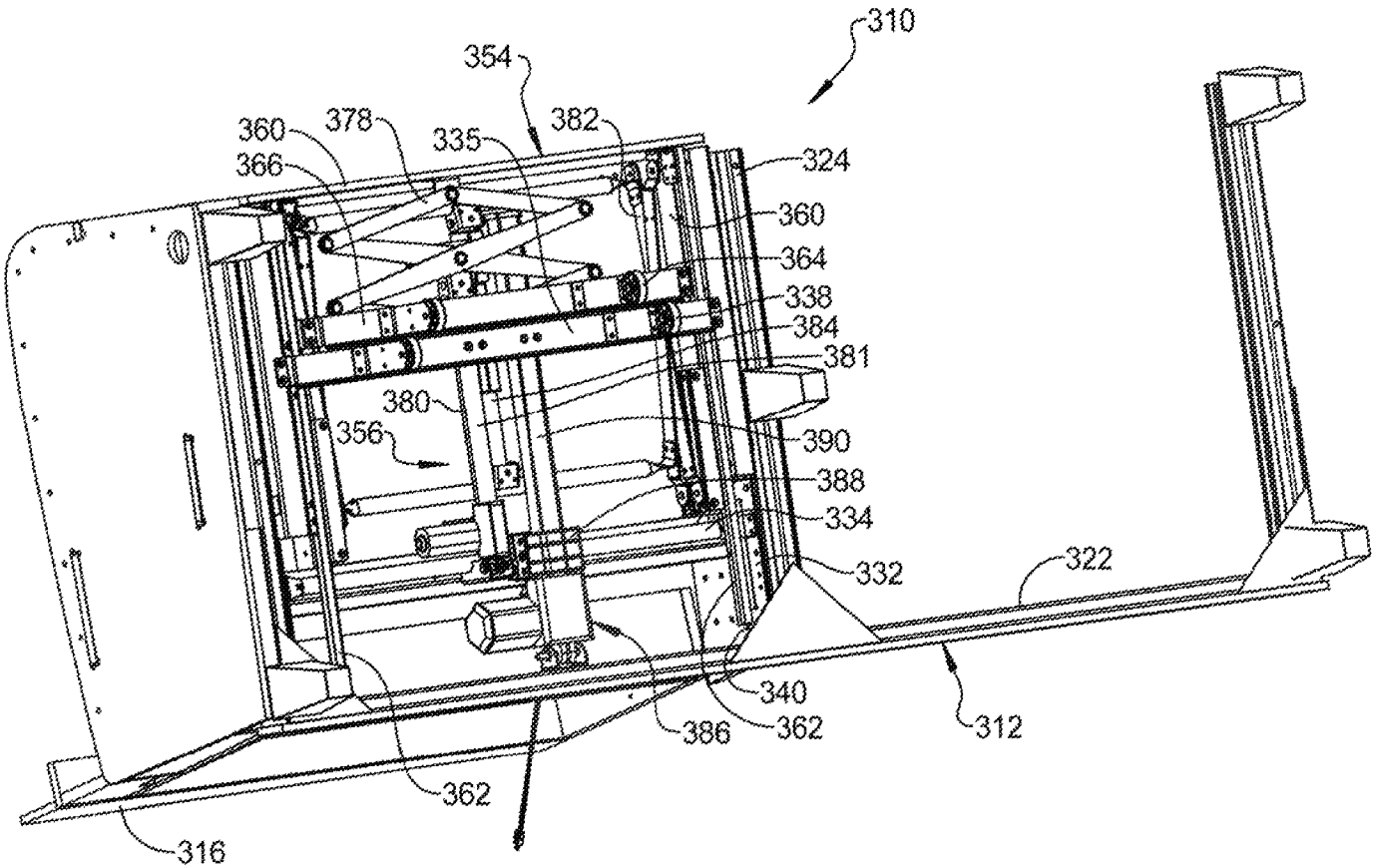
FIG. 20 is another perspective view of the portion of the furniture member of FIG. 18 with the seatback in the upright position and the ottoman assembly in the stowed position.

As shown in FIG. 19, a user may choose to arrange the furniture member 310 within a room such that when the seatback 316 is in the upright position and the ottoman assembly in the stowed position, the seatback 316 is in close proximity to a wall W (i.e., the top of the seatback 316 may be a distance D1 from a wall W and the base frame 312 is a distance D2 from the wall W). As shown in FIG. 27, the furniture member 310 can be moved to the sleeper position without the user having to move the base frame 310 further away from the wall W. That is, the seatback 316 and the ottoman assembly 320 can be moved among all of their positions without the user having to move the base frame 312 away from the wall W.

In fact, in the particular configuration shown in the figures, the top of the seatback 316 is further away from the wall W (i.e., a distance D3) in the sleeper position than in the upright position. This means that there is more clearance between the wall W and the furniture member 310 in the sleeper position than in the upright position, as the distance D3 is greater than the distance D2, and the distance D1 is less than the distance D2. This additional clearance from the wall W provides for additional clearance for an occupant's head relative to the wall W. In this manner, a tall person whose head may be higher than the top of the seatback 316 when the seatback 316 is in the upright position can remain seated in the furniture member 310 while the furniture member 310 is moved into to the fully horizontal sleeper position and still have clearance between his/her head and the wall W.

The furniture member 310 can include a control interface including buttons, switches or dials that a user can manipulate to control the first, second and third motor-driven actuators 380, 384, 386. For example, one button or set of buttons may control the third motor-driven actuator 386 to move the seat bottom 318 and the seatback 316 between the upright and sleeper positions. Another button or set of buttons may control the first and second motor-driven actuators 380, 384 to perform a sequenced movement of the ottoman assembly 320 from the stowed position to the extended position and then from the extended position to the raised position.

While not shown in the figures, in some configurations, the seatback cushion 392 could have a built-in raised headrest/pillow surface.

It will be appreciated that the user may choose to position the seatback 316 at any desired position between the fully upright and fully level sleeper position.

It will also be appreciated that the user may be seated in the furniture member 310 in the upright position and remain seated in the furniture member 310 as the furniture member moves into the sleeper position (at which time the user would be in a lying position). That is, the person can be sitting in the furniture member 310 in the upright position (i.e., with his/her buttocks contacting the seat bottom cushion 394 and with his/her back contacting the seatback cushion 392) and move the ottoman platform 352 to the fully extended and fully raised positions and the seatback 316 into the fully horizontal sleeper position while maintaining contact between his/her buttocks and the seat bottom cushion 394 and between his/her back and the seatback cushion 392 during the entire range of motion of the seatback 316 and seat bottom 318. Conventional sleeper sofas require the occupant to standup out of the sofa before the sofa can be moved into a bed configuration.

It will be appreciated that the seatback 316 and seat bottom 318 can be moved into the sleeper position independently of the ottoman assembly 320. That is, the seatback 316 and seat bottom 318 can be moved back and forth between the upright and sleeper positions while the ottoman assembly 320 remains in the stowed position. Similarly, the ottoman assembly 320 can be moved among the stowed, extended and raised positions independently of movement of the seatback 316 and seat bottom 318.

In some configurations, the lift mechanism 372 may be configured so that the user could choose to raise the ottoman cushion 358 to a height that is greater than the height of the seatback 316 and/or seat bottom 318 in the sleeper position or greater than the height of the seat bottom 318 in the upright position (e.g., about 2 inches greater).

The particular configuration of the furniture member 310 has two seat assemblies 314. It will be appreciated from the present disclosure that the furniture member 310 could be configured such that the user could choose to either simultaneously move both seat assemblies 314 between the upright and sleeper positions or move one of the seat assemblies 314 between the upright and sleeper positions independently of the other seat assembly 314.

It will be appreciated that the structure and function of the ottoman assemblies 20, 120, 320 and the seatback 316 and seat bottom 318 described above allow the furniture members 10, 310 to be designed to have many aesthetic features that are typically only found in stationary furniture. Furthermore, the structure and function of the ottoman assemblies 20, 120, 320 and the seatback 316 and seat bottom 318 described above allow the seat cushion 394 to have a thickness (e.g., about 8 inches) that is substantially greater than cushion thicknesses of conventional motion furniture. Conventional motion furniture typically requires thinner seat bottom and seatback cushions (often about 2-3 inches) to provide clearance for operation of the mechanisms moving the seatback and/or seat bottom. The thicker seat bottom cushion 394 of the present disclosure allows the user to lay lengthwise on the furniture member 310 without contacting seat rails or mechanism parts due to the low profile of the frame members and mechanism parts described therein.

It will be appreciated that the furniture members 10, 310 could be sofas (e.g., with three or more seat assemblies 14, 314), loveseats (e.g., with two seat assemblies 14, 314) or chairs (e.g., with one seat assembly 14, 314).

With reference to FIGS. 30-34, an ottoman platform 452 (FIGS. 30, 31 and 34) is provided that can be incorporated into any of the ottoman assemblies 20, 120, 320 described above instead of the ottoman platforms 32, 132, 352. As described above, the ottoman platform 452 can be moved horizontally between the stowed and extended positions by the extension mechanism 370 and moved vertically relative to the ottoman frame 354 between the extended and raised positions by the lift mechanism 372. One or more shroud panels 440 (FIGS. 32-34) can be attached to the ottoman platform 452 and the ottoman frame 354 to block a person's view of the extension mechanism 370 and lift mechanism 372 when the ottoman platform 452 is in the raised position (as described above with respect to the shroud 40). In some configurations, four shroud panels 440 can be attached to the ottoman platform 452 (i.e., one shroud panel 440 on each side of the ottoman platform 452) to fully shield the extension mechanism 370 and lift mechanism 372 from the user's view.

The ottoman platform 452 can be a rigid platform having a plurality of slots 454 that extend through an upward-facing surface 456 (i.e., a surface that supports a user's feet and/or legs when the ottoman platform 452 is in the raised position) and a downward-facing surface (i.e., the surface opposite the upward-facing surface 456).

The shroud panels 440 can be a sheet of upholstery (e.g., leather or fabric). The upholstery can be selected to match or coordinate with the upholstery covering the rest of the furniture member 310, for example. Each shroud panel 440 includes an inward-facing surface 442 (i.e., the surface that faces inward toward the mechanisms 370, 372 when the ottoman platform 452 is in the raised position; shown in FIG. 33) and an outward-facing surface 444 (i.e., the surface that faces outward away from the mechanisms 370, 372 when the ottoman platform 452 is in the raised position; shown in FIGS. 32 and 34).

Figure 31:
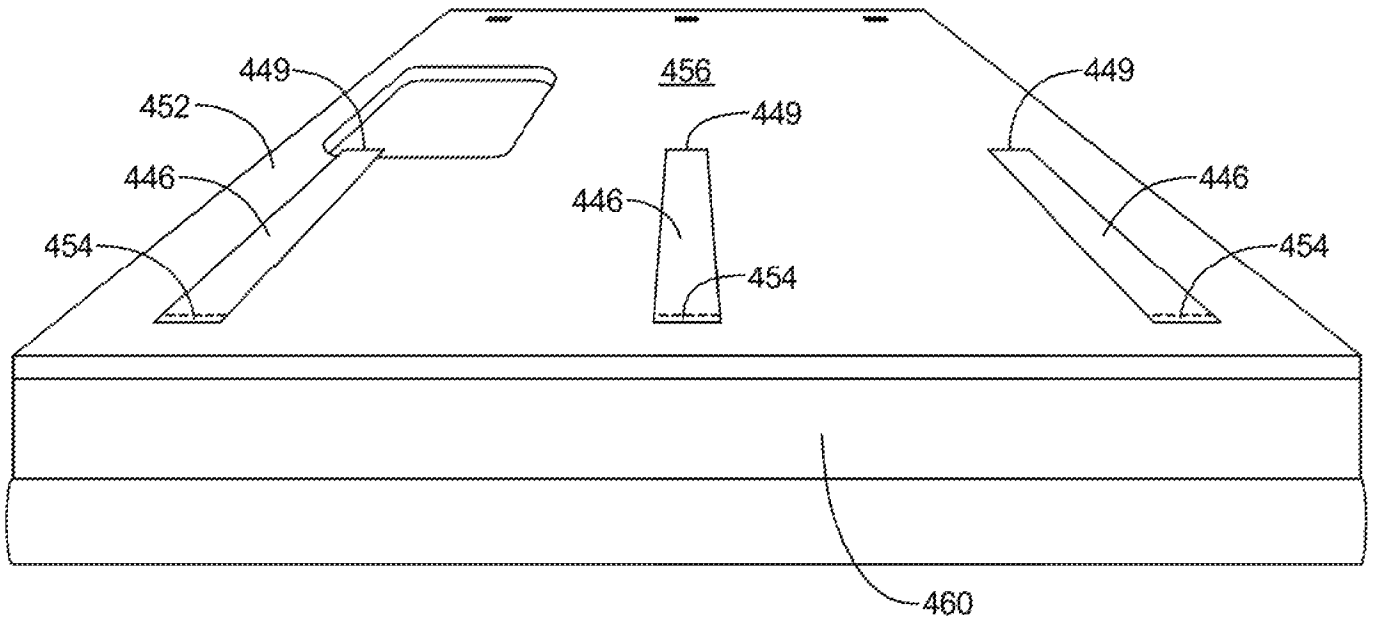
FIG. 31 is a perspective view of the ottoman platform of FIG. 30.
Figure 32:
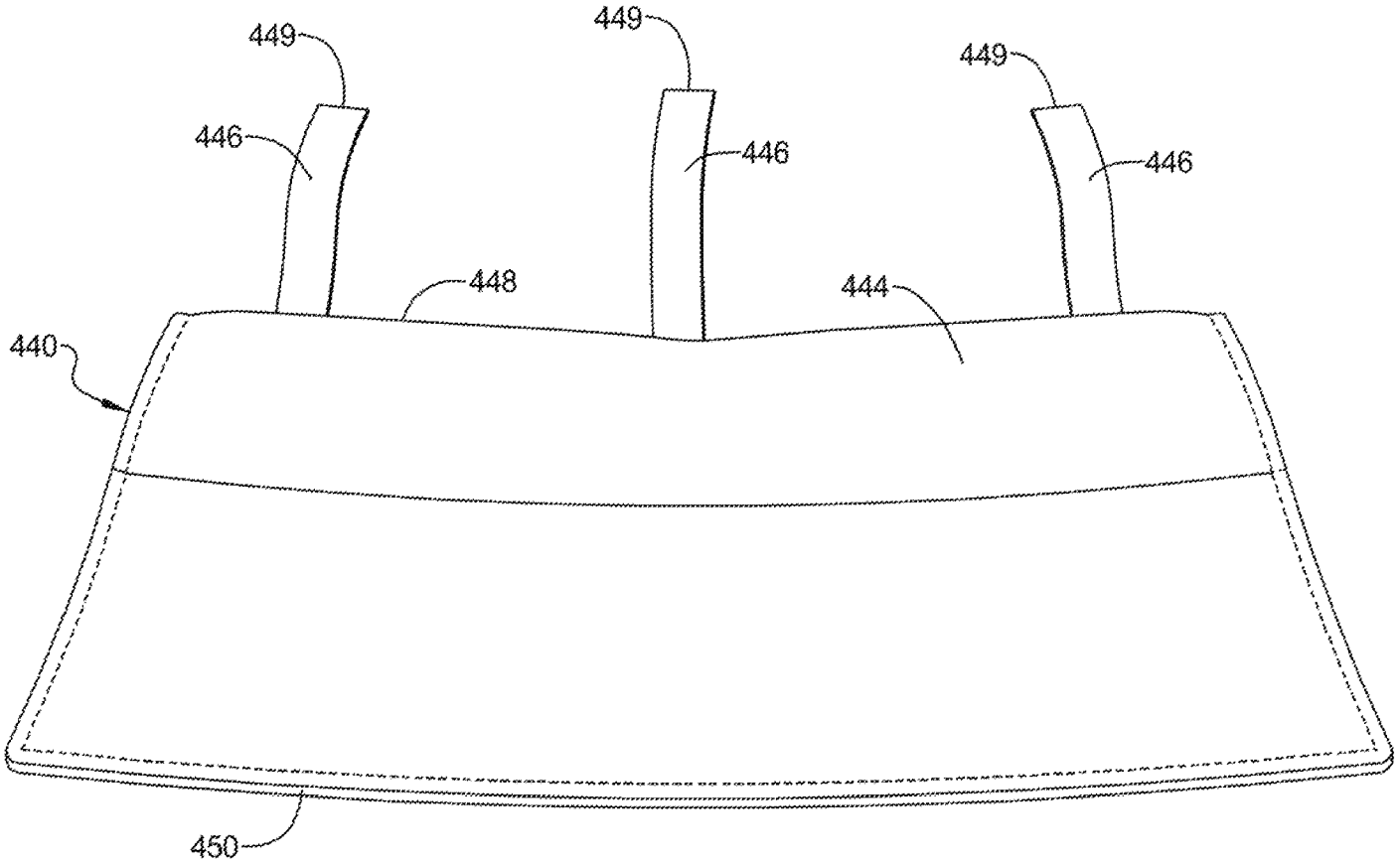
FIG. 32 is a perspective view of a first side of a shroud panel.
Figure 33:
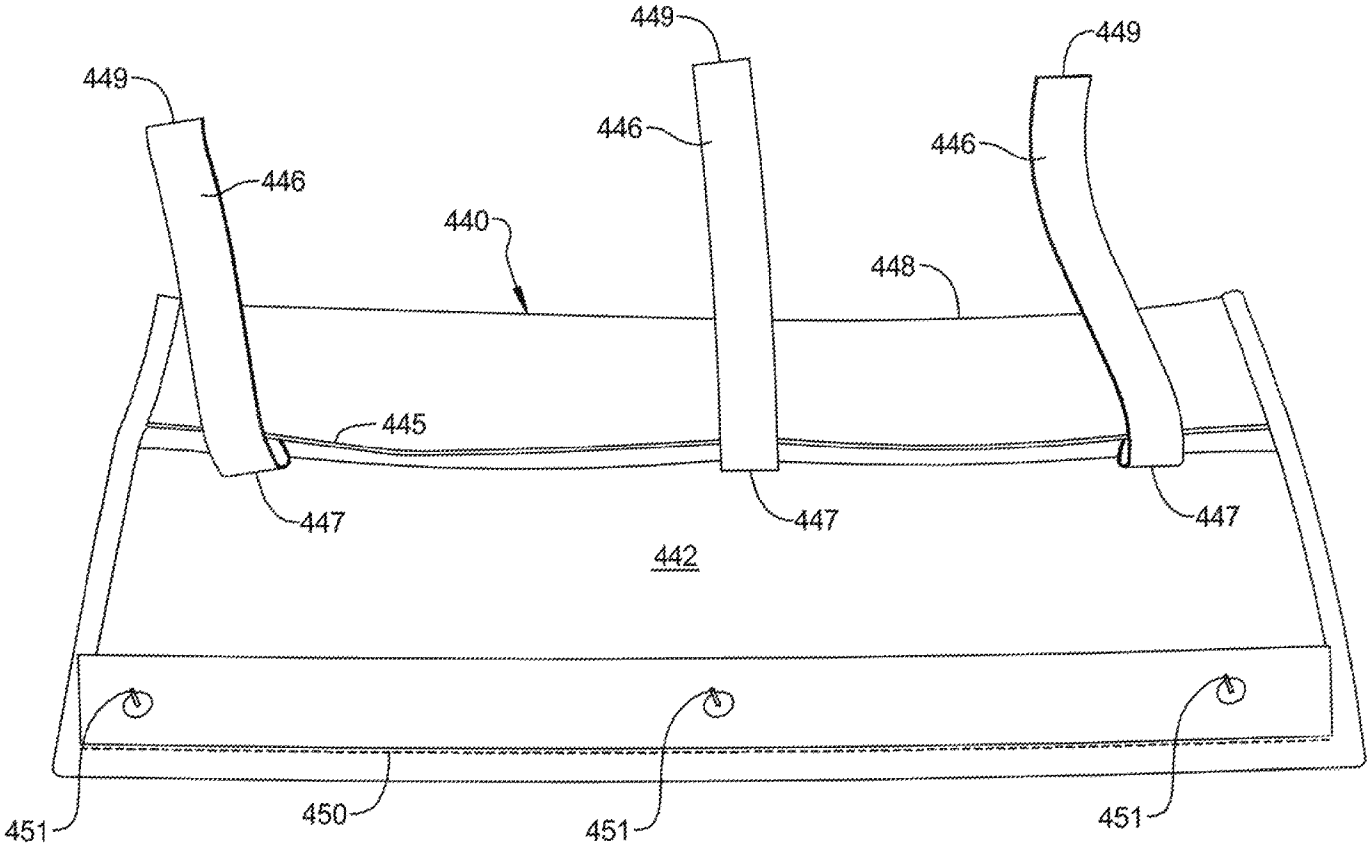
FIG. 33 is a perspective view of a second side of the shroud panel of FIG. 32.
Figure 34:
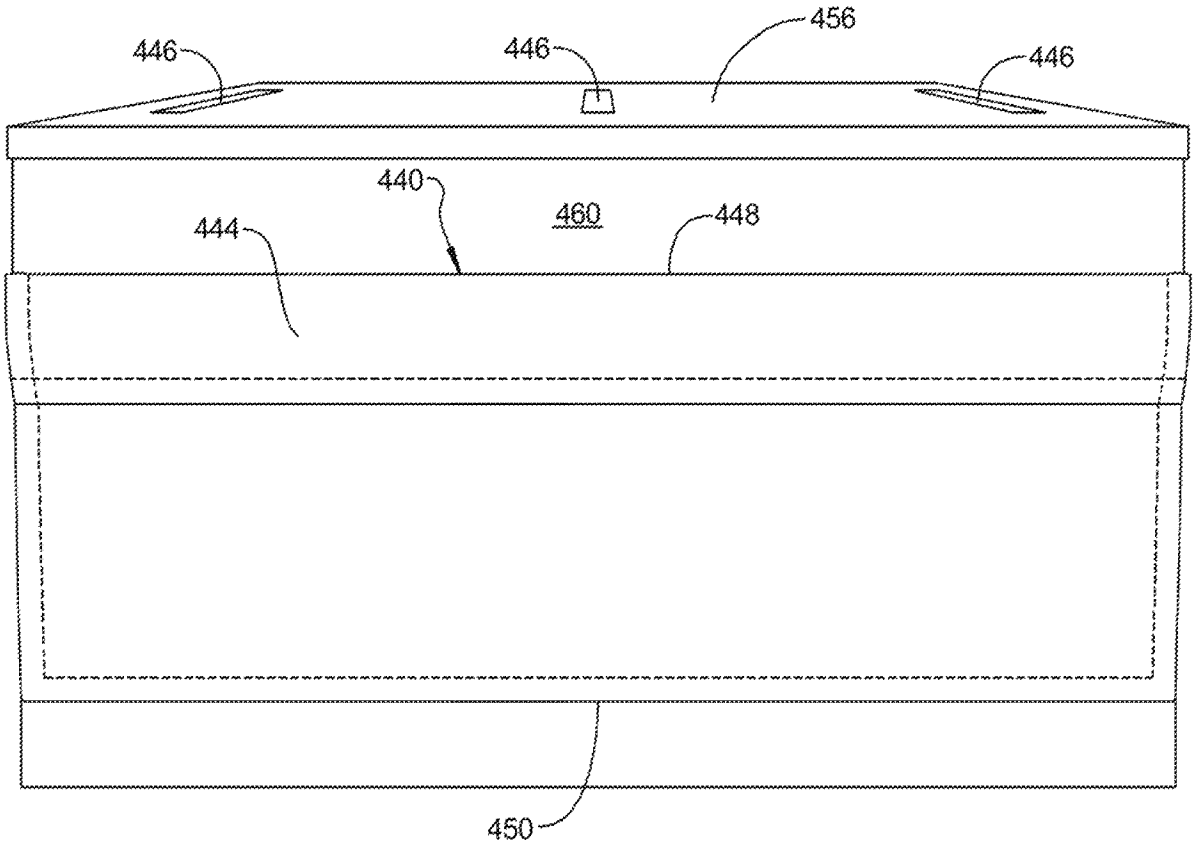
FIG. 34 is a perspective view of the ottoman platform of FIG. 30 with the shroud panel of FIG. 32 attached thereto.

A plurality of elastic strips 446 may be attached (e.g., sewn or stapled) at one end 447 to the inward-facing surface 442 of each shroud panel 440 at a flap of upholstery at a seam 445 that is spaced apart from an upper edge 448 of the shroud panel 440, as shown in FIG. 33. The elastic strips 446 can be inserted up through the slots 454 in the ottoman platform 452 so that the other ends 449 of each elastic strip 446 can be attached (e.g., stapled) to the upward-facing surface 456 of the ottoman platform 452, as shown in FIG. 31. Accordingly, the elastic strips 446 extend vertically upward through the slots 454 and horizontally over at least a portion of the upward-facing surface 456.

The upper edge 448 of each shroud panel 440 can be attached to a corresponding side 460 of the ottoman platform 452. A lower edge 450 of each shroud panel 440 can be fixedly attached (e.g., via Christmas tree fasteners 451; FIG. 33) to an outward-facing side of a corresponding frame member 360 (FIG. 23) of the ottoman frame 354. Vertically extending edges of adjacent shroud panels 440 may be sewn together so that the shroud panels 440 cooperate to form a single shroud that extends around the periphery of the ottoman platform 452. In some examples, the seam 445 may be located anywhere between approximately one-quarter and one-half of the distance from the upper edge 448 to the lower edge 450.

Figure 9:
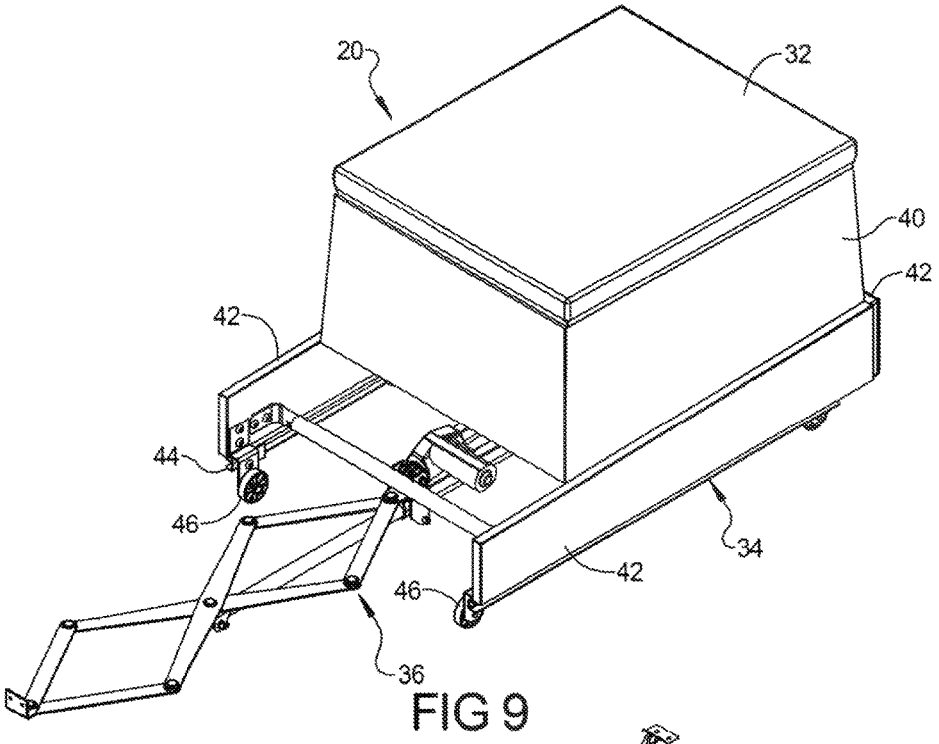
FIG. 9 is a perspective view of the ottoman assembly of FIG. 1 in the raised position.

With the shroud panels 440 attached to the ottoman platform 452 and the ottoman frame 354 in the manner described above, the shroud panels 440 can move between a folded condition when the ottoman platform 452 is in the stowed and extended positions (in which portions of the shroud panels are tucked underneath the ottoman platform 452) to an unfurled condition when the ottoman platform is in the raised position (like the shroud 40 shown in FIG. 9). When the ottoman platform is moved into the fully raised position, the shroud panels 440 are under a tension (between the upper and lower edges 448, 450) that straightens the shroud panels 440 into the unfurled condition.

This straightening of the shroud panels 440 into the unfurled condition causes the elastic strips 446 to stretch (i.e., the elastic strips 446 are stretched more and more as the ottoman platform approaches the fully raised position). Therefore, as the ottoman platform 452 is moved back down away from the fully raised position, a spring force of the stretched elastic strips 446 pulls the seam 445 of the shroud panel 440 inward toward a location beneath the ottoman platform 452. Accordingly, the shroud panels 440 become folded underneath the ottoman platform 452 as the ottoman platform 452 is moved downward away from the raised position. That is, each shroud panel 440 is folded such that upper and lower portions of the outward-facing surface 444 are facing each other.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A furniture member comprising:

a base frame;

a seat bottom attached to the base frame and defining a seating surface;

an ottoman assembly including a drive assembly that moves an ottoman platform relative to the seat bottom and the base frame among a retracted position, an extended position and a raised position, the ottoman platform including a support surface that faces upward and away from a ground surface in the retracted, extended and raised positions, wherein the ottoman platform is disposed beneath the seating surface in the retracted position and moves linearly in a horizontal direction from the retracted position to the extended position, and wherein the ottoman platform moves linearly in a vertically upward direction from the extended position to the raised position;

wherein the furniture member further comprises:

a shroud panel attached to the ottoman platform and movable with the ottoman platform between a folded condition and an unfurled condition as the ottoman platform moves vertically between the extended position and the raised position, wherein the shroud panel shields the drive assembly from a user's view when the ottoman platform is in the raised position; and an elongated elastic strip fixed at one end to the shroud panel and fixed at the other end to the upward-facing support surface of the ottoman platform, wherein movement of the ottoman platform toward the raised position resiliently stretches the elastic strip such that movement of the ottoman platform downward away from the raised position allows the elastic strip to pull a portion of the shroud panel underneath the ottoman platform.

2. The furniture member of claim 1, wherein the seat bottom is stationary relative to the base frame as the ottoman platform moves among the retracted, extended and raised positions.

3. The furniture member of claim 1, wherein the drive assembly includes a first motor-driven actuator driving the ottoman platform between the retracted and extended positions and a second motor-driven actuator driving the ottoman platform between the extended and raised positions.

4. The furniture member of claim 3, further comprising:

a third motor-driven actuator drivingly connected to the seat bottom and driving the seat bottom horizontally relative to the base frame; and a seatback pivotably attached to the seat bottom and the base frame such that movement of the seat bottom relative to the base frame causes corresponding rotation of the seatback relative to the seat bottom and the base frame.

5. The furniture member of claim 4, wherein operation of the first and second motor-driven actuators is sequenced together and the third motor-driven actuator is operable independently of the first and second motor-driven actuators.

6. The furniture member of claim 4, wherein the ottoman platform is movable horizontally relative to the base frame from the raised position to an ottoman sleeper position in response to movement of the seat bottom horizontally relative to the base frame.

7. The furniture member of claim 6, wherein the seatback includes a first side that faces a seatback cushion when the seatback is in an upright position, wherein the seatback is rotated into a seatback sleeper position as the ottoman platform moves into the ottoman sleeper position, and wherein the first side of the seatback faces vertically upward in the seatback sleeper position such that the seatback cushion cooperates with an ottoman cushion and a seat bottom cushion to define a horizontal sleep surface.

8. The furniture member of claim 7, wherein a person can remain seated on the seat bottom with the person's back contacting the seatback cushion throughout the entire range of motion of the seatback and the ottoman assembly.

9. The furniture member of claim 1, wherein the ottoman assembly includes an ottoman frame supporting the ottoman platform, an extension mechanism attached to the ottoman frame and the base frame and moving the ottoman platform between the retracted and extended positions, and a lift mechanism attached to the ottoman frame and the ottoman platform and moving the ottoman platform between the extended and raised positions.

10. The furniture member of claim 9, wherein the ottoman frame includes a plurality of rollers mounted thereto that roll along the ground surface as the ottoman assembly moves between the extended and retracted positions.

11. The furniture member of claim 9, wherein the lift mechanism includes a first scissor linkage.

12. The furniture member of claim 11, wherein the extension mechanism includes a second scissor linkage that operates independently of the first scissor linkage.

13. The furniture member of claim 9, wherein the extension mechanism includes a telescoping member attached to the base frame at one end and attached to the ottoman frame at another end.

14. The furniture member of claim 9, wherein the seat bottom includes a pair of first track members, and the ottoman frame includes a pair of second track members that slidingly engage the first track members.

15. The furniture member of claim 14, wherein the first track members slide along the second track members in a linear path.

16. The furniture member of claim 15, wherein the base frame includes a pair of third track members, wherein the seat bottom slidably engages the third track members, and wherein the third track members extend in a linear direction.

17. The furniture member of claim 1, wherein an upward-facing surface of a seat bottom cushion is substantially level with an upward-facing surface of an ottoman cushion of the ottoman platform when the ottoman platform is in the raised position.

18. The furniture member of claim 1, further comprising a seatback that is fixed relative to the seat bottom and the base frame.

19. The furniture member of claim 1, wherein the shroud panel is pulled taut in the unfurled condition.

20. The furniture member of claim 1, wherein the ottoman platform includes a slot through which the elastic strip extends.

21. The furniture member of claim 20, wherein an upper edge of the shroud panel is fixed to a side of the ottoman platform, and a lower edge of the shroud panel is fixed to an ottoman frame member supporting the drive assembly.

22. The furniture member of claim 21, wherein the elastic strip is attached to a seam of the shroud panel that is disposed between the upper and lower edges.

* * * * *